US009409741B2

(12) United States Patent
Osada et al.

(10) Patent No.: US 9,409,741 B2
(45) Date of Patent: Aug. 9, 2016

(54) SHEET PROCESSING DEVICE, IMAGE FORMING DEVICE PROVIDED WITH THE SAME, AND SHEET BONDING METHOD

(71) Applicants: Hisashi Osada, Yamanashi-ken (JP); Hideyuki Kubota, Yamanashi-ken (JP); Eiji Fukasawa, Yamanashi-ken (JP)

(72) Inventors: Hisashi Osada, Yamanashi-ken (JP); Hideyuki Kubota, Yamanashi-ken (JP); Eiji Fukasawa, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 49 days.

(21) Appl. No.: 14/570,497

(22) Filed: Dec. 15, 2014

(65) Prior Publication Data

US 2015/0175379 A1 Jun. 25, 2015

(30) Foreign Application Priority Data

| | | |
|---|---|---|
| Dec. 20, 2013 | (JP) | 2013-263878 |
| Dec. 20, 2013 | (JP) | 2013-263879 |
| Dec. 20, 2013 | (JP) | 2013-263880 |
| Dec. 20, 2013 | (JP) | 2013-263881 |
| Jan. 27, 2014 | (JP) | 2014-012190 |

(51) Int. Cl.

| | |
|---|---|
| ***B65H 37/04*** | (2006.01) |
| ***B65H 37/06*** | (2006.01) |
| ***B65H 45/18*** | (2006.01) |

(52) U.S. Cl.

CPC ..... *B65H 37/04* (2013.01); *B65H 37/06* (2013.01); *B65H 45/18* (2013.01); *B65H 2801/27* (2013.01)

(58) Field of Classification Search

CPC ..... B65H 37/04; B65H 37/06; B65H 45/18; B65H 2801/27

USPC ..... 270/58.07; 412/37

See application file for complete search history.

(56) References Cited

U.S. PATENT DOCUMENTS

| | | | | | |
|---|---|---|---|---|---|
| 4,540,458 | A * | 9/1985 | Baughman | B42C 1/12 | 156/195 |
| 4,611,741 | A * | 9/1986 | Wilson | B42C 1/12 | 227/99 |
| 6,474,387 | B1 * | 11/2002 | Shimao | B07C 5/02 | 156/364 |
| 6,616,135 | B1 * | 9/2003 | Shida | B42C 9/0006 | 156/364 |
| 6,845,978 | B2 * | 1/2005 | Silverbrook | B42C 1/12 | 270/58.12 |
| 2008/0080959 | A1 * | 4/2008 | Magata | G03B 27/32 | 412/33 |
| 2008/0224379 | A1 * | 9/2008 | McNamara | B65H 31/00 | 270/58.09 |
| 2011/0280625 | A1 * | 11/2011 | Kushida | B65H 45/18 | 399/122 |
| 2013/0133837 | A1 | 5/2013 | Naraoka | | |

(Continued)

FOREIGN PATENT DOCUMENTS

| | | | |
|---|---|---|---|
| JP | 2008297059 | A * | 12/2008 |
| JP | 2011-201698 | A | 10/2011 |

(Continued)

*Primary Examiner* — Patrick Mackey
(74) *Attorney, Agent, or Firm* — Manabu Kanesaka

(57) ABSTRACT

A sheet processing device includes a carry-in path, and a retreat path that branches off from the carry-in path. A bonding device is disposed at a merging point between the carry-in path and retreat path. An adhesive-applied position of a preceding sheet is retreated to the retreat path when a next sheet is carried in to the stacker section, and then the next sheet is moved to a bonding position. The above operations are sequentially repeated to form a sheet bundle. Thus, the sheet bundle can be formed by bonding the sheets using an adhesive. It is possible to reduce stress to be applied to the sheet, and to comparatively reduce movement of the sheet applied with the adhesive, thereby preventing the sheets from being bonded to each other at a position other than a predetermined position.

20 Claims, 23 Drawing Sheets

(56) References Cited

U.S. PATENT DOCUMENTS

2015/0086298 A1* 3/2015 Kubota ..... G03G 15/6544 412/16
2015/0174941 A1* 6/2015 Osada ..... B42C 9/0081 412/37
2015/0183613 A1* 7/2015 Awano ..... B65H 45/18 358/1.12
2015/0251475 A1* 9/2015 Taguchi ..... B42C 9/0081 412/8
2015/0309464 A1* 10/2015 Kubota ..... G03G 15/6582 399/407

FOREIGN PATENT DOCUMENTS

JP 2012144376 A * 8/2012
JP 5168474 B2 3/2013
JP 2013-112527 A 6/2013
JP 5382597 B2 1/2014

* cited by examiner

SHEET PROCESSING DEVICE, IMAGE FORMING DEVICE PROVIDED WITH THE SAME, AND SHEET BONDING METHOD

RELATED APPLICATIONS

The present application is based on, and claims priority from, Japanese Applications No. JP2013-263878 filed Dec. 20, 2013, No. JP2013-263879 filed Dec. 20, 2013, No. JP2013-263880 filed Dec. 20, 2013, No. JP2013-263881 filed Dec. 20, 2013, and No. JP2014-012190 filed Jan. 27, 2014 the disclosure of which is hereby incorporated by reference herein in its entirety.

BACKGROUND OF THE INVENTION

1. Field of the Invention

The present invention relates to a processing device that bonds paper sheets carried out from an image forming device, such as a copying machine or a printer, to form a paper sheet bundle and to a device capable of processing paper sheets successively delivered.

2. Description of the Related Art

A sheet processing device that aligns paper sheets delivered from an image forming device and staples the paper sheets or folds the paper sheets in a booklet form is widely known. Such a sheet processing device is provided with a plurality of sheet storage means for sheet post-processing. For example, in a first sheet storage means, the paper sheets are stored in a bundle and are then stapled and, in a second sheet storage means, the paper sheets stored in a bundle are subjected to saddle stitching and then folded in a booklet form. In recent years, a binding processor that binds a paper sheet bundle without use of a metallic binding needle (metallic staple) in the sheet bundle binding processing and a sheet processing device that uses the binding processor are being provided.

For example, Jpn. Pat. Appln. Laid-Open Publication No. 2011-201698 discloses a device that performs bookbinding without use of a metallic binding staple so as to enhance recyclability and safety of the bound paper sheets. In this device, a folding plate and a folding roller pair apply folding to a paper sheet bundle stored in a stacker for storing a plurality of paper sheets in order. A binding mechanism section binds the paper sheet bundle, without use of the metallic staple, in a position at a predetermined interval from a folding position where the paper sheet bundle is subjected to folding by the folding plate and the folding roller pair.

In the binding processing, the binding mechanism section causes deformation in a thickness direction of the paper sheet bundle that has been subjected to folding by the folding plate and the folding roller pair so as to bind the paper sheet bundle. More specifically, upper and lower concave-convex crimping teeth are meshed with each other to cause local deformation in the thickness direction of the paper sheet bundle to make the paper sheets to be engaged with each other (see FIGS. 4 and 5 of Jpn. Pat. Appin. Laid-Open Publication No. 2011-201698).

A portion to which the binding mechanism applies binding is set so as to be separated by a predetermined interval from the folding position of the paper sheet bundle (see FIGS. 7 and 11 of Jpn. Pat. Appin. Laid-Open Publication No. 2011-201698). In other words, the folding position and binding position are shifted from each other.

On the other hand, U.S. Patent Application Publication No. 2013/0133837 (corresponding to Jpn. Pat. Appin. Laid-Open Publication No. 2013-112527) discloses technology that applies a heat sensitive adhesive to paper sheets for bonding to obtain a paper sheet bundle. In this invention, an application section that applies the adhesive is provided at a sheet processing device entrance which is located on an upstream side relative to a sheet processing section that stores the paper sheets in a sheet conveying direction. The application section applies the adhesive to one surface or both surfaces of the carried paper sheet at a portion to be folded. The resultant paper sheet is conveyed along a comparatively long conveying path to a stacker section for sheet storage by means of several stages of conveying rollers. After conveyance to the stacker section, the adhesive-applied positions of the paper sheets are pressurized by a pressure roller to form a paper sheet bundle. Then, the obtained paper sheet bundle is pushed to a folding roller by a folding blade for folding processing.

Further, Japanese Patent No. 5,168,474 discloses a bookbinding device provided with a unit housing section that can alternatively houses one of a needle binding unit that applies a needle binding processing to a paper sheet bundle and a paste binding unit that applies pasting onto the paper sheets and pressure-bonds them to form a paper sheet bundle. To this end, the needle binding unit and paste binding unit are set so as to be detachably attached to the unit housing section. Further, this device includes a folding section that folds the paper sheet bundle bound by one of the above units in two.

Further, Japanese Patent No. 5,382,597 discloses a device provided with a paste binding unit that applies pasting onto the paper sheets and pressure-bonds them to form a paper sheet bundle and a needle binding unit that performs a needle binding processing. The device alternatively executes the paste binding and needle binding and then executes folding processing. With this configuration, a booklet can be created by paste binding or needle binding according to the need.

In the device that aligns paper sheets carried out from an image forming device or the like for subsequent binding processing and/or folding, when the paper sheet bundle is formed without use of the metallic staple or by bonding the paper sheets, the following problems arise.

The invention disclosed in Jpn. Pat. Appin. Laid-Open Publications No. 2011-201698 is configured to bind the paper sheet bundle by deforming the paper sheets themselves. For example, upper and lower concave-convex crimping teeth are meshed with each other to cause local deformation in the thickness direction of the paper sheet bundle to make the paper sheets to be engaged with each other. However, it is necessary to mesh the upper and lower concave-convex crimping teeth with a considerable crimping force in order to make the paper sheets to be engaged with each other. An insufficient crimping force results in insufficient binding, that is, only the crimping force cannot make the binding state stable. When the binding position is made to coincide with the folding position in this crimping system, a deformation force due to curve of the paper sheets acts to affect binding performance.

Further, as another binding mechanism, there is known a mechanism including a cut forming section that forms a cut bent in a convex shape on one side of a paper sheet bundle and a binding portion forming section that forms, inside a range surrounded by the convex-shaped cut, a binding portion for binding the paper sheet bundle, wherein the convex-shaped cut is inserted into the binding portion for binding. In this case, a comparatively large cut is formed in the paper sheets themselves, so that damage is given to the paper sheets themselves, and outer appearance is affected.

Under such circumstances, as disclosed in U.S. Patent Application Publication No. 2013/0133837 (corresponding to Jpn. Pat. Appin. Laid-Open Publication No. 2013-112527), the binding mechanism that binds the paper sheet bundle using an adhesive without use of the crimping mechanism or without forming large cut in the paper sheets can be considered effective.

However, in this mechanism, the paper sheet is conveyed along a comparatively long conveying path to a stacker section for sheet storage by means of several stages of conveying rollers, as described above. That is, the sheet applied with an adhesive at the device entrance is conveyed to the stacker section along the comparatively long conveying path through several conveying rollers, so that a sheet jam may occur due to undesired adhesion of the adhesive to surroundings of the conveying path.

Further, the adhesive-applied paper sheets stored in the stacker section for bonding are not necessarily aligned with one another, and the paper sheet may be folded in a mutually misaligned state. In addition, in order to prevent the adhesive from being adhered to the surroundings of the long conveying path, it is necessary to select, as a pressure sensitive tape used as the adhesive, one that does not exhibit adhesive power until it receives a significant pressure. That is, it is necessary to carefully select the adhesive to be used and to use a special pressurizing mechanism.

On the other hand, in the device disclosed in Japanese Patent No. 5,168,474, one of the needle binding unit and paste binding unit can be attached to the unit housing section of the device. In this configuration, when the paste binding unit is selected to perform pasting, a paper sheet is carried in the unit with a pasting surface (bonding surface) of a preceding paper sheet being exposed, so that the paper sheets may be bonded to each other at an unintended portion. Further, the paper sheet after the pasting is conveyed to a folding device by a distance two or more times a sheet length, so that the adhesive may be adhered to the device component.

In the device disclosed in Japanese Patent No. 5,382,597, the paste binding unit and needle binding unit are arranged side by side in the sheet conveying path. Although the paper sheet is conveyed by a suction feeding mechanism in this device, a paper sheet (second paper sheet) is carried in the unit with a pasting surface (bonding surface) of a preceding paper sheet (first paper sheet) being exposed as in the paste binding unit disclosed in Japanese Patent No. 5,168,474. Therefore, for example, a leading end of the second paper sheet to be carried in may be brought into contact with the adhesive on the first paper sheet, with the result that the paper sheets may be bonded to each other at an unintended portion. Further, also in this device, the paper sheet after the pasting is conveyed to an inside of the device by a distance two or more times a sheet length, so that the adhesive may be adhered to the device component.

The present invention has been made in view of the above problems, and an object thereof is to provide a comparatively small sheet processing device capable of forming a paper sheet bundle by bonding the paper sheets using an adhesive to reduce stress to be applied to the paper sheet as compared to a case where the paper sheet bundle is bound with a metallic staple or by deforming the paper sheets themselves, capable of comparatively reducing movement of the paper sheet applied with the adhesive to prevent the adhesive from being adhered to a portion other than the paper sheet in the conveying path or stacker section, and capable of reliably bonding the paper sheets through the adhesive at a predetermined position while suppressing the adhesive from being adhered to an unnecessary portion, an image forming device provided with the sheet processing device, and a sheet bonding method.

SUMMARY OF THE INVENTION

To solve the above problems, the present invention has the following means.

That is, the present invention provides a sheet processing device that applies an adhesive onto a paper sheet for bonding paper sheets. The sheet processing device includes: a carry-in path along which the paper sheet is carried in; a stacker section that stores the paper sheet conveyed along the carry-in path; a regulating member that regulates the paper sheet stored in the stacker section; a moving member that moves the stored paper sheet; a bonding member that applies the adhesive onto the paper sheet at a bonding position; and a retreat path that branches off from the carry-in path, along which at least a part of the paper sheet stored in the stacker section is retreated in a direction opposite to a sheet carry-in direction, wherein the bonding member is disposed at a merging point between the carry-in path and retreat path, an adhesive-applied position of a preceding paper sheet is retreated to the retreat path by the moving member when a next paper sheet is carried into the stacker section, and then the next paper sheet is moved to the bonding position for adhesive application, and the above paper sheet retreat operation and adhesive application operation are repeated to generate a paper sheet bundle. The present invention further provides an image forming device provided with the above sheet processing device and a sheet bonding method.

The sheet bonding method includes the steps of: applying the adhesive onto a preceding paper sheet at a bonding position; retreating an adhesive-applied position of the preceding paper sheet to the retreat path; carrying in a next paper sheet to the stacker section; moving the next paper sheet to the bonding position with leading end sides of the preceding and next paper sheets overlapped with each other for adhesive application and sheet bonding. The above steps are repeated to generate a paper sheet bundle.

With the above configuration, in the present invention, the next paper sheet is carried in after the adhesive-applied position of the preceding paper sheet is moved to the retreat path, and the retreat and carry-in operations are repeated to thereby generate a paper sheet bundle.

Thus, a paper sheet bundle can be generated by bonding the paper sheets using an adhesive, so that it is possible to reduce stress to be applied to the paper sheet as compared to a case where the paper sheet bundle is bound with a metallic staple or by deforming the paper sheets themselves. Further, it is possible to comparatively reduce movement of the paper sheet applied with the adhesive to prevent the adhesive from being adhered to a portion other than the paper sheet, thereby preventing the paper sheets from being bonded to each other at a position other than a predetermined position. As a result, there can be provided a sheet processing device, through small, that can bond the paper sheets at a predetermined position, an image forming device provided with the sheet processing device, and a sheet bonding method.

BRIEF DESCRIPTION OF THE DRAWINGS

FIGS. 5A to 5C are explanatory views of the adhesive application device of FIG. 3, in which FIG. 5A is a plan view, FIG. 5B illustrates an engagement state between a cam member and a stamper holder, and FIG. 5C is an explanatory view of the cam member;

FIG. 6A is an outer appearance view, FIG. 6B is a view illustrating a state where an adhesive tape is wound around a reel, FIG. 6C is a view illustrating a gear state before pressing of the adhesive tape stamper, FIG. 6D is a view illustrating a gear state upon pressing of the adhesive tape stamper;

FIGS. 12A and 12B are sheet flow diagrams for explaining a flow of the paper sheet when the paper sheets are bonded to each other to form a paper sheet bundle, in which FIG. 12A illustrates a state where a first paper sheet is carried into the carry-in path, and FIG. 12B illustrates a state where a rear end of the first paper sheet passes through a branching point between the carry-in path and retreat path;

FIGS. 13A and 13B are sheet flow diagrams continued from FIG. 12B, in which FIG. 13A illustrates a state where the first paper sheet is moved to a bonding position with the rear end of the first paper sheet retreated to the retreat path, and FIG. 13B illustrates a state where an adhesive is applied (transferred) onto the first paper sheet stopped at the bonding position;

FIGS. 14A and 14B are sheet flow diagrams continued from FIG. 13B, in which FIG. 14A illustrates a state where an adhesive-applied position of the first paper sheet is retreated to the retreat path, and FIG. 14B illustrates a state where a second paper sheet is carried into the stacker section from the carry-in path;

FIGS. 15A and 15B are sheet flow diagrams continued from FIG. 14B, in which FIG. 15A illustrates a state where sheet alignment is performed with a leading end of the second paper sheet abutting against the stopper section and overlapped with the leading end of the first paper sheet, and FIG. 15B illustrates a state where the rear ends of the first and second paper sheets pass through the branching point between the carry-in path and retreat path;

FIGS. 16A and 16B are sheet flow diagrams continued from FIG. 15B, in which FIG. 16A illustrates a state where the first and second paper sheets are moved to the bonding position while being gripped by the gripper, where adhesive application and sheet pressing are performed, and FIG. 16B illustrates a state where carry-in of a third paper sheet is waited for with the adhesive-applied position of the first and second paper sheets in a bundled state retreated to the retreat path;

FIGS. 17A and 17B are sheet flow diagrams continued from FIG. 16B, in which FIG. 17A illustrates a state where sheet alignment is performed with a leading end of the last third paper sheet abutting against the stopper section, and FIG. 13B illustrates a state where the first to third paper sheets are moved to the bonding position while being gripped by the gripper, where adhesive application is performed;

FIGS. 18A and 18B are sheet flow diagrams continued from FIG. 17B, in which FIG. 18A illustrates a state where a rear end of the third paper sheet once passes through the branching point between the carry-in path and retreat path, and FIG. 18B illustrates a state where all the first to third paper sheets are switchback-conveyed to the retreat path;

FIGS. 20A to 20D are explanatory views of a folding roller mechanism in the device illustrated in FIG. 2, in which FIG. 20A illustrates a state where the paper sheet bundle is stored, FIG. 20B illustrates a state where the paper sheet bundle is inserted between a pair of folding rollers by a folding blade, FIG. 20C illustrates a state where an initial state of the folding processing by the folding roller pair, and FIG. 20D illustrates a state where the paper sheet bundle is being folded by the folding roller pair;

FIGS. 21A to 21C are explanatory views each illustrating a relationship between a sheet pressing slider illustrated in FIGS. 3, 4, and 6 and a platen, in which FIG. 21A is an enlarged view of a bottom surface of the sheet pressing slider, FIG. 21B is an explanatory view explaining a position at which a transfer head applies an adhesive tape onto the paper sheet, and FIG. 21C is a view explaining a state where the last paper sheet is not applied with the adhesive but pressed by the sheet pressing slider (here, a fourth paper sheet is the last paper sheet);

FIGS. 22A and 22B are modifications of a pressing mechanism of the sheet pressing slider illustrated in FIGS. 21A to 21C, in which FIG. 22A illustrates a mechanism that uses a pressure roller as the sheet pressing member, and FIG. 22B illustrates a mechanism that uses a pair of rollers as the sheet pressing member.

DESCRIPTION OF THE EMBODIMENTS

Figure 1:
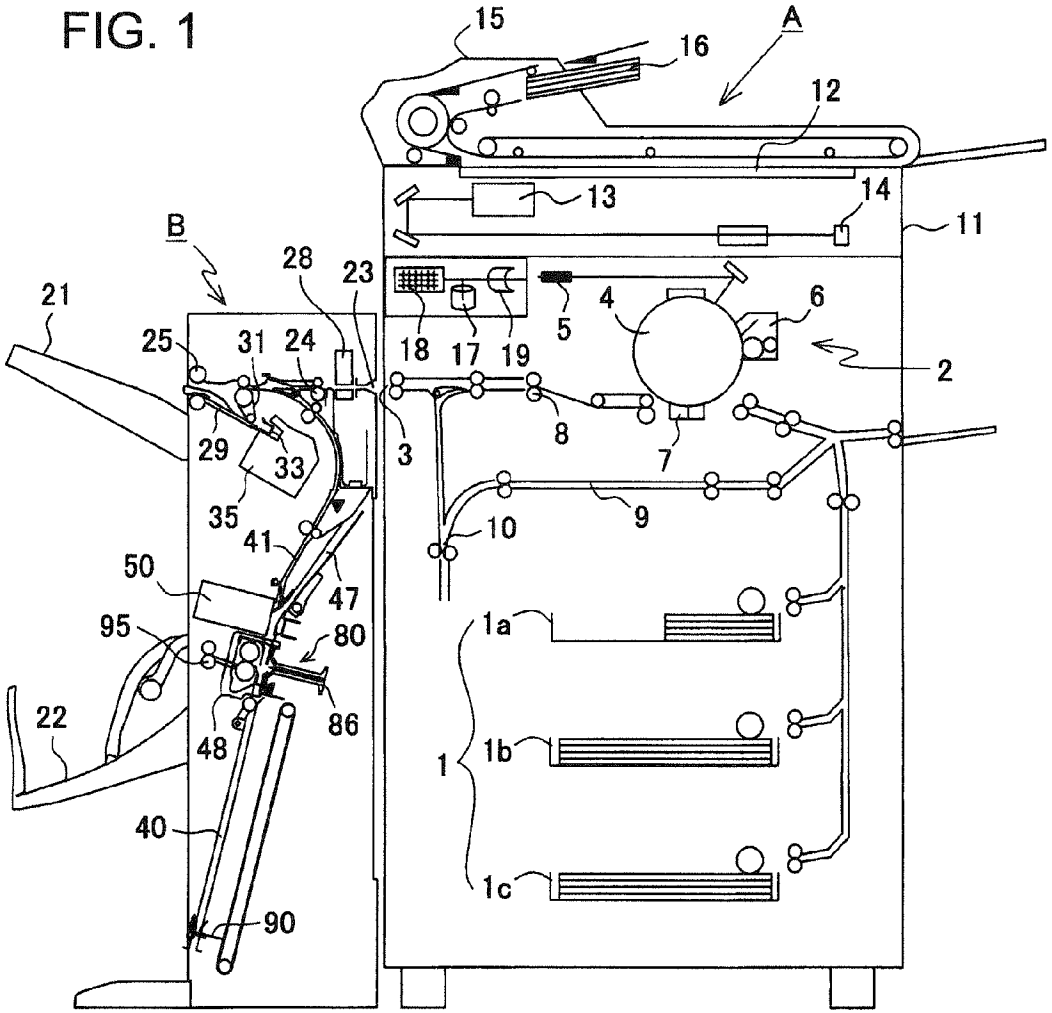
FIG. 1 is an explanatory view illustrating an entire configuration in which an image forming device and a sheet processing device according to the present invention are combined.
Figure 2:
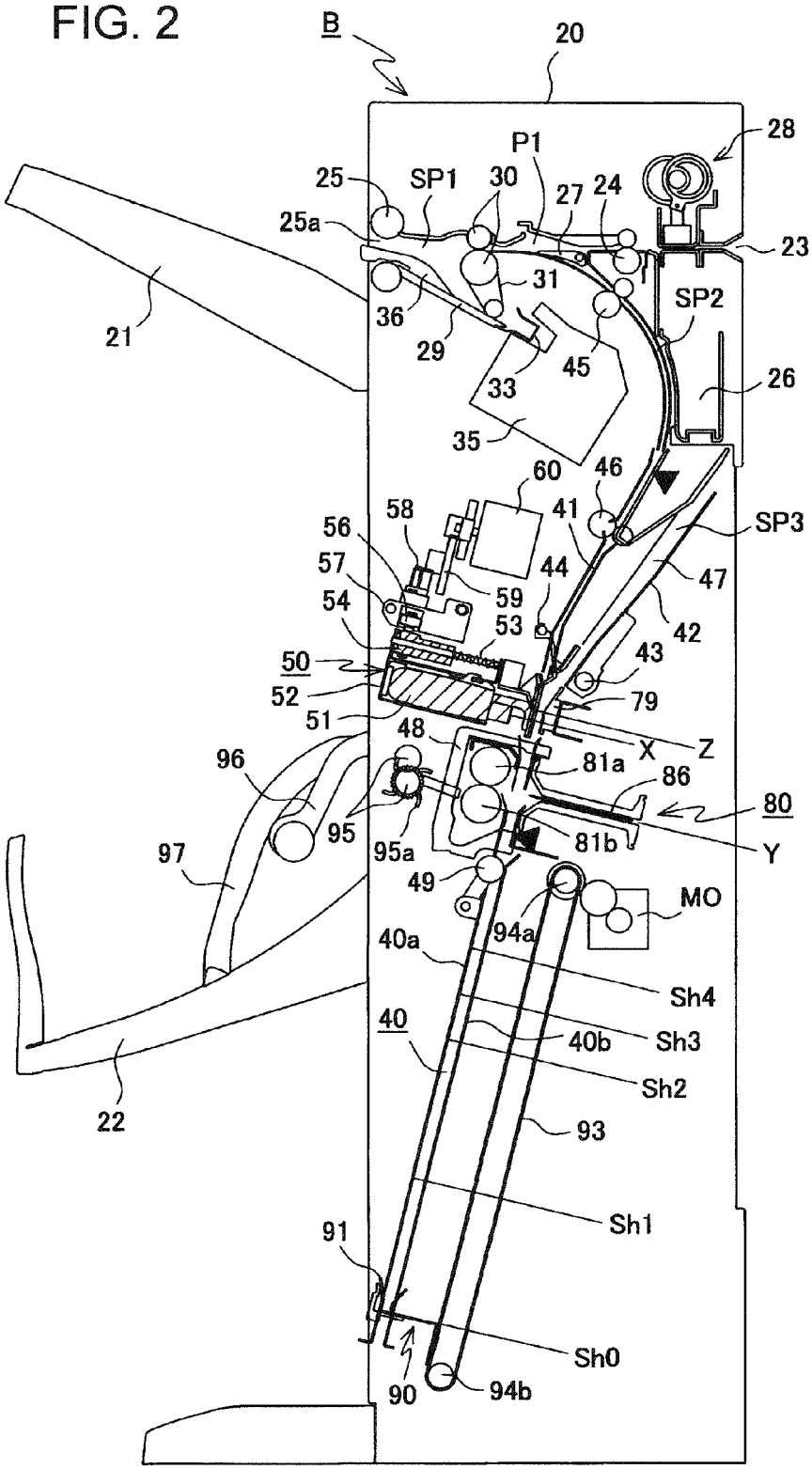
FIG. 2 is an explanatory view illustrating an entire configuration of the sheet processing device according to the present invention provided with an adhesive application device.

Hereinafter, the present invention will be described based on a preferred embodiment illustrated. FIG. 1 is an explanatory view illustrating an entire configuration in which an image forming device and a sheet processing device according to the present invention are combined, FIG. 2 is an explanatory view illustrating an entire configuration of the sheet processing device, and FIG. 3 and subsequent figures are explanatory views each illustrating a mechanism configuration of the sheet processing device. A configuration illustrated in FIG. 1 is constituted by an image forming device A and a sheet processing device B, and an adhesive application device 50 is integrated as a unit in the sheet processing device B.

[Configuration of Image Forming Device]

The image forming device A illustrated in FIG. 1 feeds a paper sheet from a sheet supply section 1 to an image forming section 2, performs printing on the paper sheet in the image forming section 2, and discharges the paper sheet after printing from a main body discharge port 3. Paper sheets of a plurality of sizes are accommodated in sheet cassettes 1*a*, 1*b*, and 1*c* of the sheet supply section 1, and the sheet supply section 1 separates, one from the other, paper sheets of a specified size and feeds them one by one to the image forming section 2. The image forming section 2 includes, e.g., an electrostatic drum 4 and a print head (laser emitter) 5, a developing unit 6, a transfer charger 7, and a fixing unit 8 which are disposed around the electrostatic drum 4. An electrostatic latent image is formed on the electrostatic drum 4 using the laser emitter 5, the developing unit 6 adds toner to the image, the transfer charger 7 transfers the image onto the paper sheet, and the fixing unit 8 thermally-fixes the image. The paper sheet with thus formed image is sequentially carried out from the main body discharge port 3. A reference numeral 9 in FIG. 1 denotes a circulation path, which is a path for two-side printing in which the paper sheet printed on the front side from the fixing unit 8 is reversed via a main body switchback path 10 and is conveyed to the image forming section 2 again for printing on the back side of the paper sheet. The paper sheet thus printed on both sides is reversed in the main body switchback path 10 and is carried out from the main body discharge port 3.

A reference numeral 11 in FIG. 1 denotes an image reader, where a document sheet set on a platen 12 is scanned by a scan unit 13 and is electrically read by a photoelectric conversion element 14 through a reflective mirror and a condensing lens. This image data is subjected to, e.g., digital processing by an image processor and is subsequently transferred to a data storage section 17, and an image signal is sent to the laser emitter 5. A reference numeral 15 denotes a document feeder that feeds document sheets stored in a stacker 16 to the platen 12.

The image forming device A having the above-described configuration is provided with a control section (controller). Image forming conditions such as, printout conditions such as a sheet size specification, a color or black-and-white printing specification, a print copy count specification, single- or double-side printing specification, and enlarged or reduced printing specification are set via a control panel 18. On the other hand, in the image forming device A, image data read by the scan unit 13 or transferred through an external network is stored in the data storage section 17. The image data stored in the data storage section 17 is transferred to a buffer memory 19, which sequentially transfers data signals to the laser emitter 5.

Simultaneously with the image forming conditions, post-processing conditions are input and specified via the control panel 18. For example, a "printout mode", a "stapling mode", and a "bonded paper sheet bundle folding mode" are specified as the post-processing conditions. The image forming device A forms an image on the paper sheet in accordance with the image forming conditions and the post-processing conditions.

[Configuration of Sheet Processing Device]

The sheet processing device B connected to the above-described image forming device A receives a paper sheet with the image formed thereon from the main body discharge port 3 of the image forming device A and is configured to (1) store the paper sheet in a first sheet discharge tray 21 ("printout mode" described above), (2) align the paper sheets from the main body discharge port 3 in a bundle to staple them and then store the paper sheets in the first sheet discharge tray 21 ("stapling mode" described above), or (3) align the paper sheets from the main body discharge port 3 in a bundle, then bond the paper sheets, fold the bonded paper sheets in a booklet form, and store the resultant paper sheets in a second sheet discharge tray 22 ("bonded paper sheet bundle folding mode" described above).

Thus, as illustrated in FIG. 2, the sheet processing device B is provided with the first sheet discharge tray 21 and second sheet discharge tray 22 in a casing 20. Further, the device B is provided with a sheet carry-in path P1 having a carry-in port 23 continued to the main body discharge port 3. The sheet carry-in path P1 is formed of a straight-line path in a substantially horizontal direction in the casing 20. Further, there are provided a first switchback conveying path SP1 and a second switchback conveying path SP2 that branch off from the sheet carry-in path P1 to convey a paper sheet in an inverse direction. The first switchback conveying path SP1 branches off from the sheet carry-in path P1 to the downstream side of the sheet carry-in path P1, the second switchback conveying path SP2 branches off from the sheet carry-in path P1 to the upstream side of the sheet carry-in path P1, and the paths SP1 and SP2 are disposed spaced apart from each other.

In such a path configuration, in the sheet carry-in path P1, there are disposed a carry-in roller 24 and sheet discharge roller 25, and the rollers 24 and 25 are coupled to a drive motor (M1) capable of rotating forward and backward. Further, in the sheet carry-in path P1, there is disposed a path switching piece 27 for guiding a paper sheet to the second switchback conveying path SP2, and the piece 27 is coupled to an operation means such as a solenoid. Further, the sheet carry-in path P1 has, on the downstream side of the carry-in roller 24, a punch unit 28 for punching the paper sheet from the carry-in port 23. The illustrated punch unit 28 is disposed, on the upstream side of the carry-in roller 24, at the carry-in port so as to be detachably mounted to the casing 20 depending on a device specification. Further, below the punch unit 28, a punch chip box for housing punch chips generated upon the punch processing is detachably attached to the casing 20.

[Configuration of First Switchback Conveying Path SP1]

The first switchback conveying path SP1 disposed, as illustrated in FIG. 2, on the downstream side (rear end portion of the device) of the sheet carry-in path P1 is configured as described below. The sheet carry-in path P1 is provided, at its exit end, with the sheet discharge roller 25 and a sheet discharge port 25*a*. A first processing tray (hereinafter, referred to as "processing tray 29") is provided downward of the sheet discharge port 25*a* across a level difference formed therebetween. The processing tray 29 includes a tray for loading and supporting the paper sheet discharged from the sheet discharge port 25*a*. There is disposed, above the processing tray 29, a forward/backward rotation roller 30. The forward/backward rotation roller 30 is coupled with the forward/backward rotation motor M1 and is controlled to be rotated in a clockwise direction in FIG. 2 when a paper sheet approaches the processing tray 29, while rotating in a counterclockwise direction after a paper sheet rear end enters the tray. The forward/backward rotation roller 30 has a lifting roller 31 coupled to a caterpillar belt so as to be movable between positions contacting the tray and separated therefrom. Therefore, the first switchback conveying path SP1 is configured above the processing tray 29.

Further, the first sheet discharge tray 21 is located downstream of the first switchback conveying path SP1 and is configured to support a leading end of paper sheet guided to the first switchback conveying path SP1 and second switchback conveying path SP2.

With the above-described configuration, the paper sheet from the sheet discharge port 25*a* reaches the processing tray 29 and is conveyed toward the first sheet discharge tray 21 by the forward/backward rotation roller 30. Once the rear end of the paper sheet reaches the processing tray 29, the forward/backward rotation roller 30 is reversely rotated (counterclockwise in the figure) to convey the paper sheet on the processing tray 29 in a direction opposite to a sheet discharge direction. At this time, the lifting roller 31 coupled to the caterpillar belt cooperates with the forward/backward rotation roller 30 to switchback-convey the rear end of the paper sheet along the processing tray 29.

A rear end regulating member 33 and an end surface stapler 35 are disposed at a rear end portion of the processing tray 29 in the sheet discharge direction. The rear end regulating member 33 regulates a position of the rear end of the paper sheet. The illustrated end surface stapler 35 staples rear end edge of a paper sheet bundle stored on the tray at one or more positions. The rear end regulating member 33 is also used to provide a function of carrying out the stapled paper sheet bundle to the first sheet discharge tray 21 located downstream of the processing tray 29. To this end, the rear end regulating member 33 is configured to be able to reciprocate in the sheet discharge direction along the processing tray 29. The illustrated rear end regulating member 33 is coupled to a not illustrated bundle discharge motor (M7) so as to be reciprocated.

The processing tray 29 has a side aligning plate 36 with which the paper sheets stored on the tray are aligned in a width direction thereof. The side aligning plate 36 includes a pair of left and right (front and rear in FIG. 2) aligning plates so as to align the paper sheets with reference to a sheet center and is configured to approach and leave the sheet center. The side aligning plate 36 is coupled to a not illustrated side aligning plate motor (M6).

The first switchback conveying path SP1 configured as described above aligns the paper sheets from the sheet discharge port 25*a* on the processing tray 29 in the "stapling mode" described above, and the end surface stapler 35 staples the paper sheet bundle at one or more portions of the rear end edge of this paper sheet bundle. In the "printout mode", a paper sheet from the sheet discharge port 25*a* is not subjected to the switchback, but the paper sheet conveyed along the processing tray 29 is carried out to the first sheet discharge tray 21 by the forward/backward rotation roller 30. Thus, the illustrated device is characterized in that the sheet to be stapled is bridged between the processing tray 29 and the first sheet discharge tray 21 to allow the device to be compactly configured.

[Configuration of Second Switchback Conveying Path SP2]

The following describes a configuration of the second switchback conveying path SP2 branching off from the sheet carry-in path P1. As illustrated in FIG. 2, the second switchback conveying path SP2 is located in a substantially vertical direction inside the casing 20. A path carry-in roller 45 is located at an entrance of the second switchback conveying path SP2, and a conveying roller 46 is located at an exit of the second switchback conveying path SP2. The conveying roller 46 is configured to be movable between a position nipping the paper sheet and a position separated from the paper sheet. This configuration will be described later in detail.

The path carry-in roller 45, located at the entrance of the second switchback conveying path SP2, is configured to be rotatable forward and backward. A sheet to be carried in the first switchback conveying path SP1 located downstream is temporarily held (temporarily reside) on the second switchback conveying path SP2. The reason for the temporary holding is as follows. That is, the preceding paper sheets are stored on the processing tray 29, stapled in response to a job completion signal, the resultant paper sheet bundle is carried out to the first sheet discharge tray 21. During this carry-out, a paper sheet conveyed from the image forming device A to the sheet carry-in path P1 is temporarily held on the second switchback conveying path SP2. Then, after the processing of the preceding paper sheet bundle is finished, the standing-by sheet is conveyed from the first switchback conveying path SP1 onto the processing tray 29.

A stacker section 40 constituting the second processing tray that aligns and temporarily stores the paper sheets conveyed along the second switchback conveying path SP2 is provided downstream of a carry-in path 41 constituting the second switchback conveying path SP2 and serving also as a paper sheet carry-in path. The illustrated stacker section 40 includes a conveying guide that conveying the paper sheets. The conveying guide is constituted by a stacker upper guide 40*a* and a stacker lower guide 40*b* and configured so that the paper sheets are loaded and housed therein. The illustrated stacker section 40 is connected to the carry-in path 41 and located in a center portion of the casing 20 in the left-right direction so as to extend in the substantially vertical direction. This allows the device to be compactly configured. The stacker section 40 is shaped to have an appropriate length to house maximum sized paper sheets therein. There are provided, inside the stacker section 40, an adhesive application device 50 as an adhesive applying section for applying an adhesive to the paper sheet and a folding section 80 including a folding blade 86 and a folding roller 81 for folding the paper sheet. These components will be described later in detail.

[Configuration of Retreat Path (Third Switchback Path SP3)]

Figure 3:
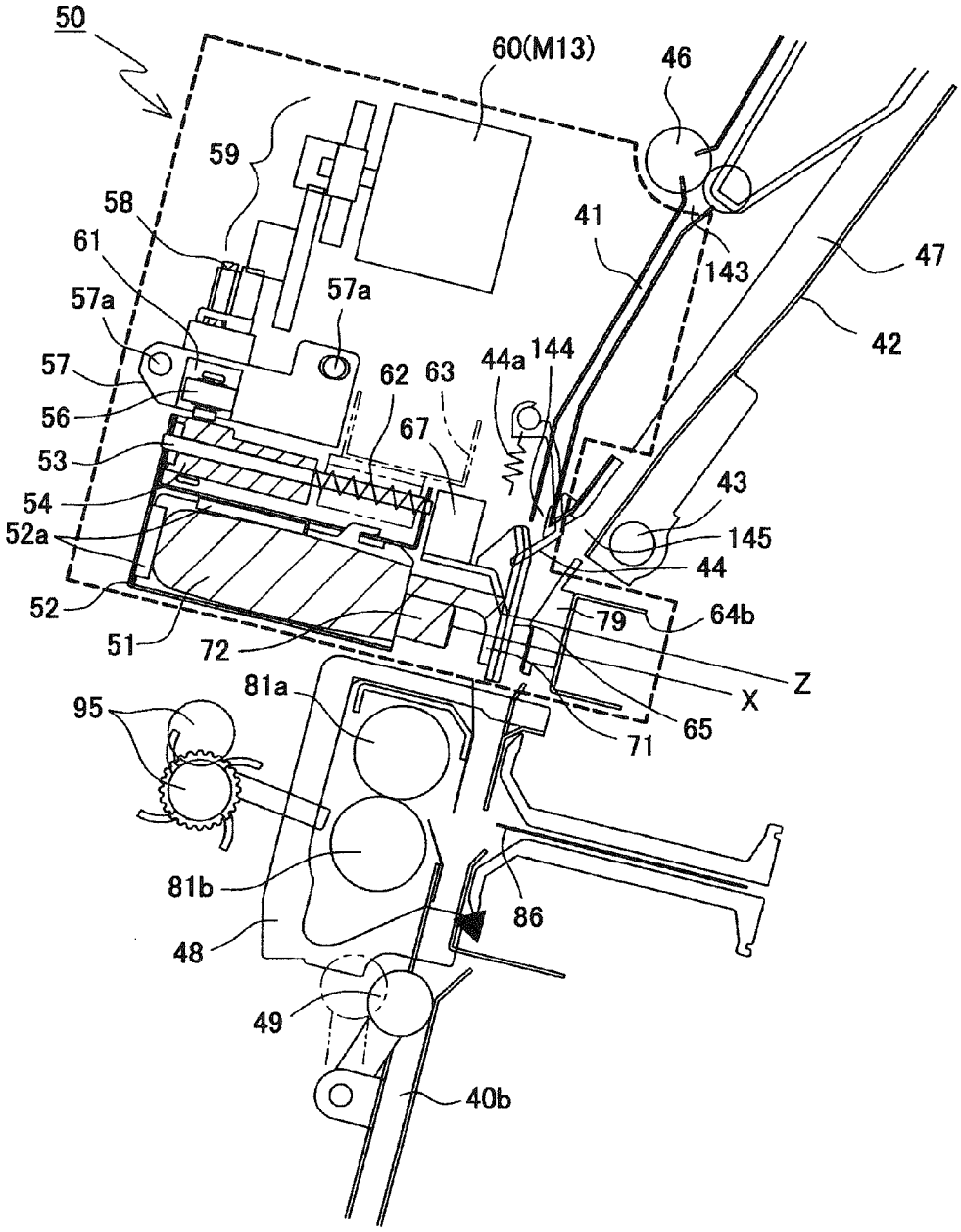
FIG. 3 is an explanatory view illustrating a peripheral mechanism of the adhesive application device of FIG. 2.

A retreat path 47 constituting a third switchback path SP3 is continuously provided from a rear end side of the stacker section 40 in a sheet conveying direction. The retreat path 47 branches off from the carry-in path 41 constituting the above-described second switchback conveying path SP2 and serving also as a path for carrying the paper sheet in the stacker section 40 and configured to overlap an exit end of the carry-in path and make the paper sheet advance thereinto in a switchback manner. As illustrated in FIGS. 2 and 3, the retreat path 47 is constituted by a switchback guide 42 formed of a plate material. Ribs are formed on a surface of the switchback guide 42 along the sheet conveying direction to smooth sheet conveying operation. Further, to cope with a case where a jam of the paper sheet bundle occurs in the retreat path, the switchback guide 42 is configured to turn about a guide releasing shaft 43 to be released.

When the rear end of the paper sheet carried in from the carry-in path 41 to the stacker section 40 passes through a position at which the retreat path 47 branches off from the carry-in path 41, the paper sheet is moved (lifted up) by a stopper section 90 as a regulating member for regulating the leading end of the paper sheet, and the rear end side of the paper sheet is switchback-conveyed to the retreat path 47 together with the paper sheet bundle in the stacker section 40.

The stopper section 90 as the regulating member for regulating the leading end of the paper sheet also serves as a moving member for moving the paper sheet by means of a gripper 91 to be described later for gripping the paper sheet. Although the regulating member and moving member may be separately provided, the functions thereof are achieved by a single member (stopper section 90) in the present embodiment.

At a merging point between the carry-in path 41 and retreat path 47, a deflection guide 44 biased by a guide tension spring 44*a* toward the switchback guide 42 side of the retreat path 47 is provided. Further, at the merging point, the adhesive application device 50 for applying an adhesive onto the paper sheet is located so as to immediately follow the deflection guide 44. The adhesive application device 50 has adhesive tape stampers 51 each serving as a bonding member. Although details will be described later, when a paper sheet (second paper sheet) is carried in from the carry-in path 41 after an adhesive tape is applied (transferred) onto a preceding paper sheet (first paper sheet) by the adhesive tape stampers 51 of the adhesive application device 50, the leading end of the second paper sheet is adhered to the adhesive-applied portion of the first paper sheet, making it impossible to apply the adhesive onto a center portion of the second paper sheet in the sheet conveying direction, thus failing to form a paper sheet bundle. For this reason, it is necessary to convey the paper sheet to the adhesive tape stampers 51 after the preceding sheet is switchback-conveyed to the retreat path 47. Thus, the retreat path 47 functions as a retreat path for the adhesive-applied paper sheet.

Further, by switching back the paper sheet to the retreat path 47, a leading end of a paper sheet to be conveyed by the conveying roller 46 of the carry-in path 41 and a rear end of a paper sheet (preceding paper sheet) that has been loaded on and supported by the stacker section 40 are overlapped with each other, thereby keeping the page order of the paper sheets to be stored.

[Outline of Configurations of Components Provided Along Path Between Retreat Path and Stopper Section]

Based on FIGS. 2 and 3, an outline of configurations of components provided along a path between the retreat path 47 and stopper section 90 will be described.

At the merging point between the carry-in path 41 and retreat path 47, the deflection guide 44 is provided, in which a spring is stretched so as to slightly press the paper sheet toward the switchback guide 42 of the retreat path 47. The deflection guide 44 has such a comb shape as to avoid the adhesive-applied portion of the paper sheet. Thus, even when the adhesive-applied paper sheet passes under the deflection guide 44, the adhesive is not adhered to the conveying path. A flow of the paper sheet in this section will be described separately later.

As illustrated in detail in FIG. 3, at the merging point between the carry-in path 41 on the downstream side of the deflection guide 44 and retreat path 47, the adhesive application device 50 for applying an adhesive onto the paper sheet is provided in the stacker section 40. A sheet presser 65 for pressing, toward the stopper section 90, a paper sheet stopped at a bonding position for regulation is mounted to the adhesive application device 50 so as to be vertically movable. Further, a sheet pressing slider 71 configured to be moved vertically to press the paper sheet and feed an adhesive tape AT as an adhesive is provided on a leading end side of the sheet presser 65. A transfer head 72 for backing up the adhesive tape AT fed from a reel is provided above the sheet pressing slider 71. The transfer head 72 is also moved between the bonding position at which it presses the paper sheet to apply the adhesive tape AT onto the paper sheet and a separated position at which it is separated from the paper sheet to allow the paper sheet to be conveyed/moved therethrough.

The "application" in the present invention includes so-called "transfer" that transfers the adhesive from a tape to the paper sheet by pressing the paper sheet. Further, the "application" includes spraying of the adhesive to the paper sheet while pressing the paper sheet.

A sheet side edge aligning member 48 configured to be moved in the sheet width direction to press a side edge of the paper sheet in the stacker section 40 is disposed on both sides of a downstream side of the adhesive application device 50. The sheet side edge aligning member 48 has a substantially U-like shape, at a center portion of which folding rollers 81*a* and 81*b* serving as the folding section and the folding blade 86 for pressing the paper sheet against the folding rollers 81*a* and 81*b* are movably provided so as to press and separate from the paper sheet. Further, a pressure roller 49 is provided so as to immediately follow the sheet side edge aligning member 48 and to contact and separate from the stacker lower guide 40*b* which is one of the guide members constituting the stacker section 40. The pressure roller 49 is separated from the paper sheet until the leading end of the paper sheet passes therethrough and, after the sheet leading end passes through the pressure roller 49, the pressure roller 49 is rotated while pressing the paper sheet against the stacker lower guide 40*b*.

A regulating member (hereinafter, referred to as "stopper section 90") for regulating the leading end of the paper sheet in the sheet conveying direction is provided on a lower end side of the stacker section 40. The stopper section 90 is supported by a guide rail of a device frame and is configured to be vertically movable along the stacker section 40 by an elevating belt 93 stretched between vertically arranged upper and lower pulleys 94*a* and 94*b*. These bridge pulleys 94 are moved by the motor (M1) to move the elevating belt 93. As described below, the elevating belt 93 is configured to move the stopper section 90 to and stop the same at positions of Sh1, Sh2, Sh3, and Sh4.

The Sh0, which is the lowermost position, is a home position of the stopper section 90. A sensor (not illustrated) is used to detect this position for initial position setting. The Sh1 is a receiving position of a first paper sheet and a position at which the rear ends of the sequentially stacked paper sheets that have passed through the carry-in path are pressed by the deflection guide 44 toward the switchback guide of the retreat path 47. The Sh2 is a position at which the paper sheet bundle is subjected to the folding at a substantially half position of the paper sheet in the sheet conveying direction. The Sh3 is a position at which the adhesive tape stampers 51 each serving as the bonding member is used to apply (transfer), in the sheet width direction, the adhesive tape AT onto the paper sheet at a substantially half position of the paper sheet in the sheet conveying direction. The Sh4 is a position at which the adhesive-applied position at which the adhesive member (adhesive tape AT) is applied onto the paper sheet is moved to the retreat path 47. More specifically, when a paper sheet (second paper sheet) is carried in from the carry-in path 41 into the stacker section 40, the adhesive-applied position of the preceding paper sheet (firs paper sheet) can be retracted to a position (application concealing position 100) separated away from the carry-in path of a subsequent sheet so as to prevent a sheet jam or adhesion of the adhesive to an unintended position due to contact of the second paper sheet with the adhesive-applied position of the first paper sheet. In this device, carry-in of the paper sheet, application of the adhesive onto the paper sheet, movement of the adhesive-applied position to the retract path, carry-in of the subsequent paper sheet, and application of the adhesive onto the subsequent paper sheet are performed to bond the paper sheets by the adhesive, and the above operations are repeatedly performed to form the paper sheet bundle. The formation of the paper sheet bundle will be described in detail later in a step by step manner.

The resultant paper sheet bundle is then folded in two by the folding section 80 and discharged to the second sheet discharge tray by a bundle discharge roller 95 provided with a bundle kick-out piece 95*a*. The discharged paper sheet bundle is stored on the second sheet discharge tray by a bundle press guide 96 for preventing a sheet loading range from being narrowed due to expansion of the bundle and a bundle presser 97 positioned downward of the bundle press guide 96.

[Configuration of Adhesive Application Device]

Figure 4:
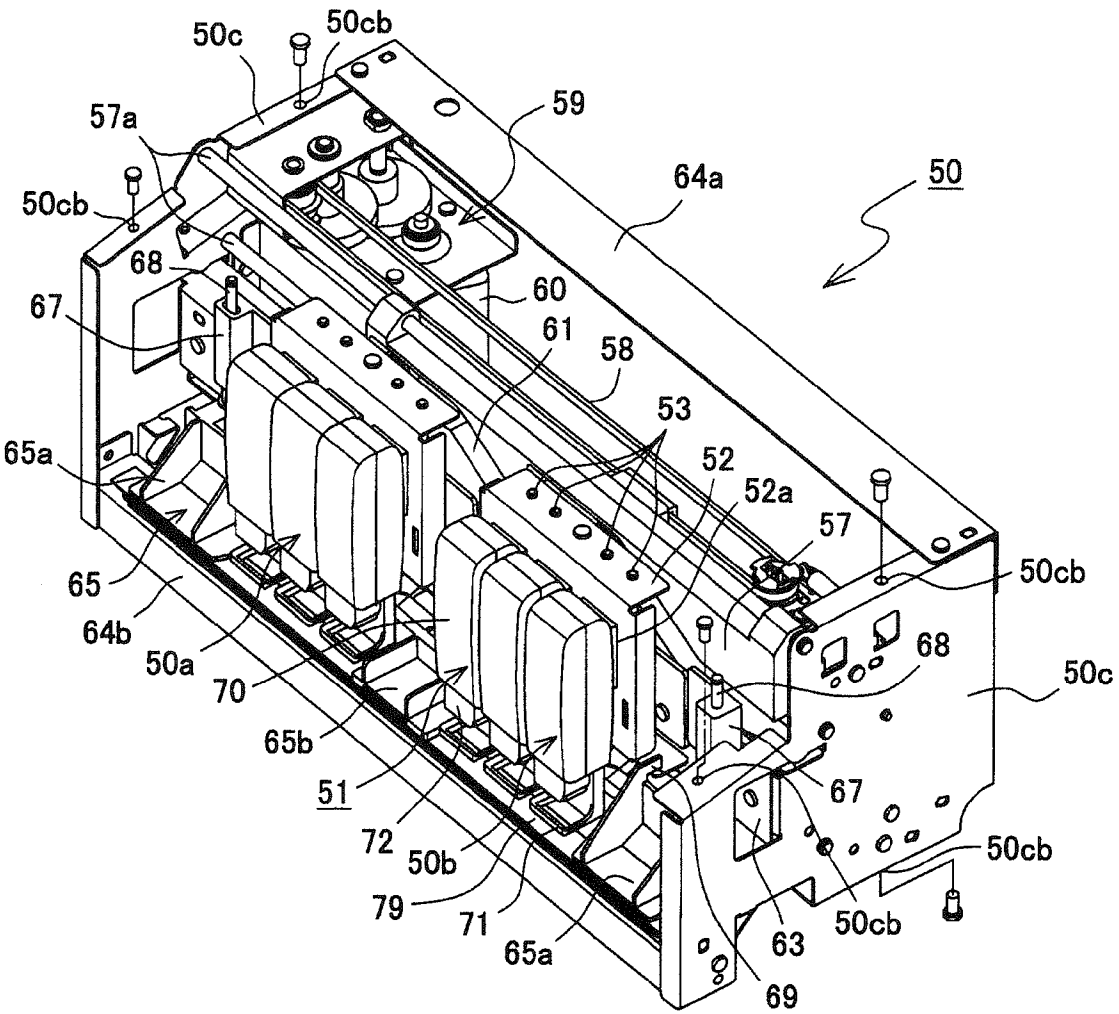
FIG. 4 is a perspective view of the adhesive application device of FIG. 2.

The following describes the adhesive application device 50 with reference to FIGS. 3 to 8. A range surrounded by a dashed line of a cross-sectional view of FIG. 3 corresponds to the adhesive application device 50. FIG. 4 is a perspective view of the adhesive application device 50, and the adhesive application device 50 is attached to the sheet processing device B with an illustrated range as a unit. FIGS. 5A to 5C are explanatory views of a main part of adhesive tape units 50*a*, 50*b*, and 50*c* constituting an adhesive unit. FIG. 5A is a plan view of a cam member 57 and the like. FIG. 5B is a front view illustrating an engagement state between the cam member 57 and a stamper holder 52. An upper stage of FIG. 5C illustrates a state where the cam member 57 is moved to a position causing the adhesive tape stampers 51 to be separated from the paper sheet, and a lower stage of FIG. 5C illustrates a state where the cam member 57 is moved to a position causing the stamper holder 52 to be pressed against the platen 79, at which the adhesive tape stampers contact the paper sheet.

Figure 6A:
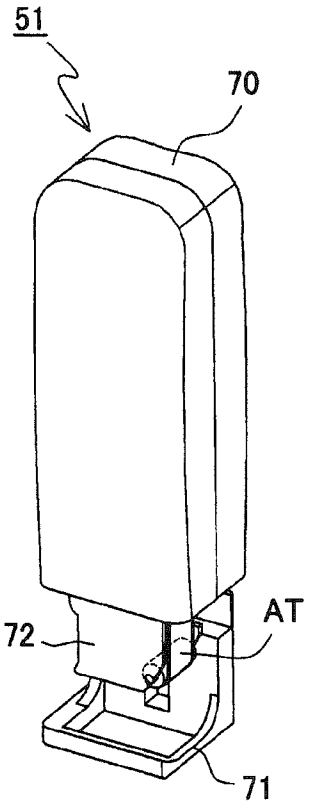
FIGS. 6A to 6D are explanatory views of an adhesive tape stamper for applying an adhesive.
Figure 6B:
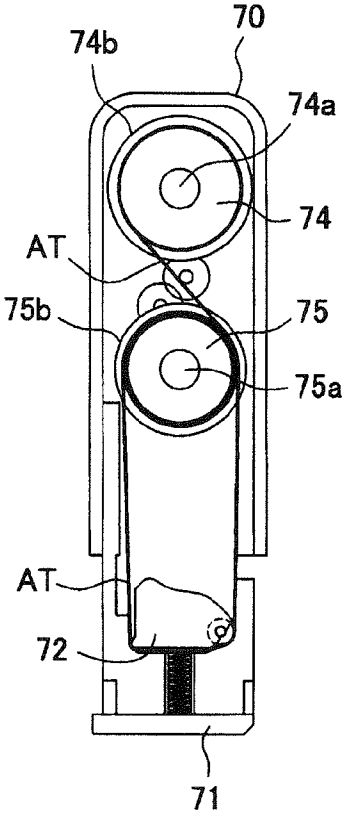
Figure 6C:
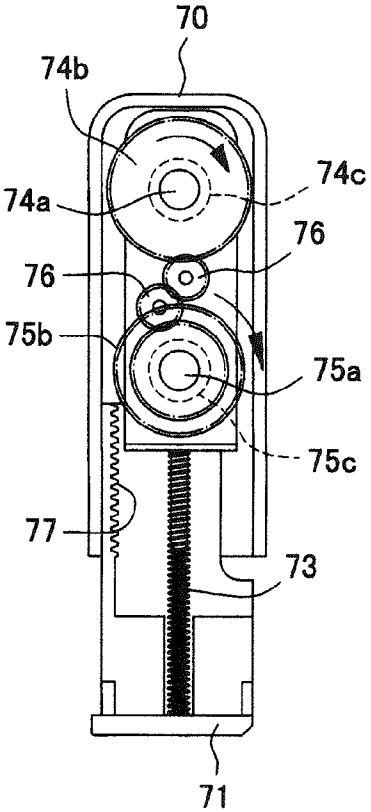
Figure 6D:
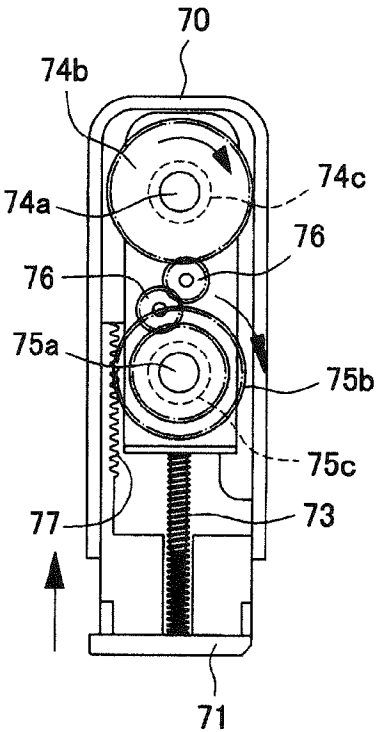

FIGS. 6A to 6D are explanatory views of the adhesive tape stampers 51 each serving as a bonding member. FIG. 6A is a perspective view, FIG. 6B is a internal mechanism view, and FIGS. 6C and 6D are views for explaining a drive mechanism for winding the adhesive tape AT in a stamping operation. FIGS. 7A to 7C and FIGS. 8A to 8C are explanatory views illustrating an operation of applying/transferring the adhesive tape onto the paper sheet performed by the adhesive tape units 50*a* and 50*b* each supporting a plurality of adhesive tape stampers 51.

A range surrounded by a dashed line of FIG. 3 corresponding to the adhesive application device 50 in the present embodiment. There are disposed, within the dashed-line range, an adhesive tape stamper 51 as a bonding member, a stamper holder 52 as a bonding unit for grouping the adhesive tape stampers 51 and supporting them in parallel, a cam member 57 that moves vertically stamper holder 52 between a position at which the stamper holder 52 is brought close to a platen 79 to press the adhesive tape stampers 51 against the paper sheet for application of the adhesive onto the paper sheet and a position at which the stamper holder 52 is separated from the platen 79, and a cam moving motor 60 (M13) that moves the cam member 57 in a direction crossing the sheet conveying direction. Further, a plurality of adhesive tape units 50*a* and 50*b* are configured to be attachable to the sheet processing device B, more specifically, to an upstream position of the stacker section 40 as a unitized adhesive application device 50. Further, in order to prevent the paper sheet from being shifted upon carry-in of the paper sheet into the stacker section 40 or switchback thereof to the retreat path 47, a part of the carry-in path 41 (more specifically, a portion from a unit path entrance 143 to a carry-in path exit 144), deflection guide 44, a part of the branching retreat path 47 (more specifically, a retreat path exit 145), and platen 79 are incorporated in the adhesive application device 50 as a unit. The adhesive application device 50 corresponding to the range surrounded by the dashed line of FIG. 3 is thus configured and is illustrated in a perspective view of FIG. 4.

Attachment of the adhesive application device 50 to the sheet processing device B is made by fixing a not illustrated fixing portion of the sheet processing device B and a stop screw hole 50*cb* formed in a frame of the adhesive application device 50 by an illustrated screw, as illustrated in FIG. 4. In place of the fixing structure using the screw, rails may be provided in the sheet processing device B and adhesive application device 50, respectively, so as to allow the adhesive application device 50 to be pulled out.

The above unitized configuration allows an increase in accuracy of a positional relationship among the components as compared to a case where the components are individually attached to the sheet processing device B, thereby, in particular, suppressing adhesion of the adhesive to an unintended position due to displacement upon movement of the paper sheet after application of the adhesive.

In the adhesive application device 50, left and right application device frames 50*c*, a center support frame 63, a rear support frame 64*a*, and a lower support frame 64*b* constitute one casing. The center support frame 63 connects the left and right application device frames 50*c* at center portions thereof. The rear support frame 64*a* connects the left and right application device frames 50*c* at rear portions thereof. The lower support frame 64*b* connects the left and right application device frames 50*c* at portions thereof below the platen 79. The cam moving motor 60 is mounted to the one of the left and right application device frames 50*c*. Drive of the cam moving motor 60 is transmitted to a moving belt 58 through a gear train 59. The moving belt 58 is connected to the cam member 57 which is configured to be slidable along two cam guide rods 57*a* extending between the left and right application device frames 50*c* in the sheet width direction. Thus, when the cam moving motor 60 is driven, the cam member 57 is moved to the left or right according to a rotating direction of the cam moving motor 60.

Figure 5A:
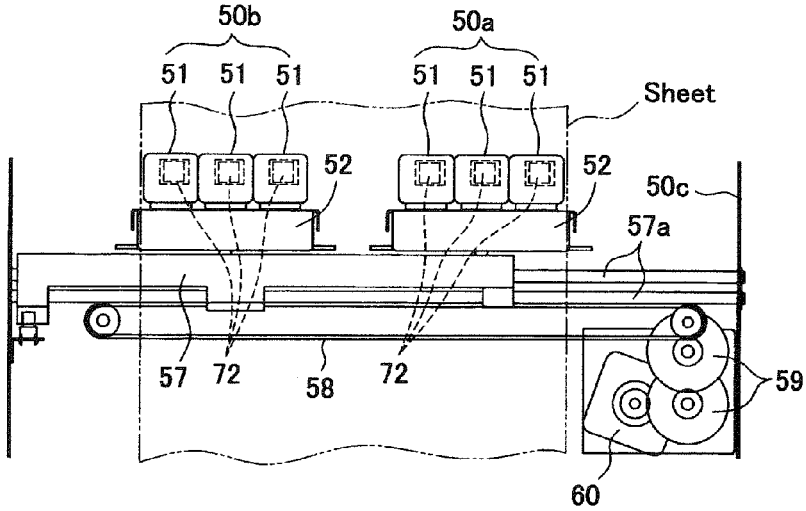
Figure 5B:
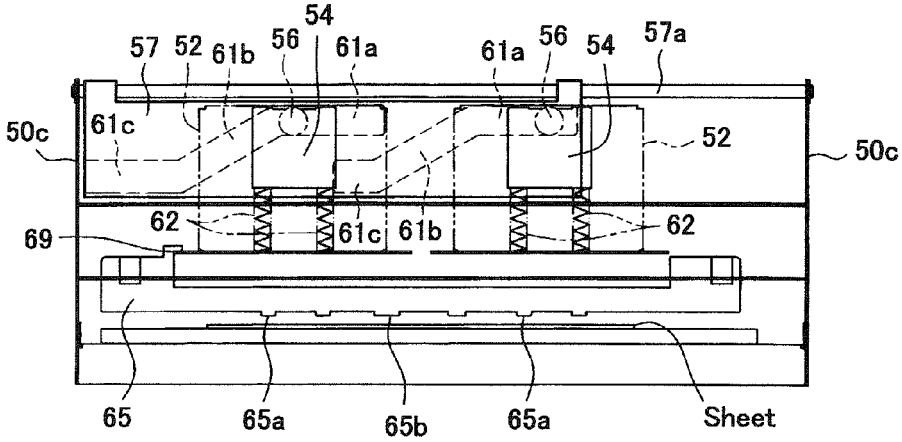
Figure 5C:
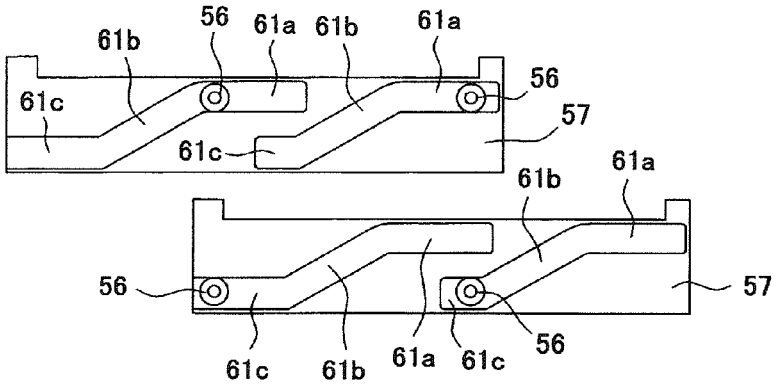

Cam grooves 61 as illustrated in FIGS. 5B and 5C are formed in the cam member 57. As illustrated, the cam member 57 includes an upper horizontal cam groove 61*a*, a lower horizontal cam groove 61*c*, and an inclined cam groove 61*b*. The upper horizontal cam groove 61*a* is positioned at an upper portion of the cam member 57. The lower horizontal cam groove 61*c* is positioned at a lower portion of the cam member 57. The inclined cam groove 61*b* connects the upper horizontal cam groove 61*a* and lower horizontal cam groove 61*c*. As illustrated, two left and right cam grooves 61 are formed in the cam member 57 and are slightly different in phase. A roller 56 serving as a cam follower and fixed to a moving block 54 for moving vertically the stamper holder 52 is fitted into each of the cam grooves 61.

Figure 7A:
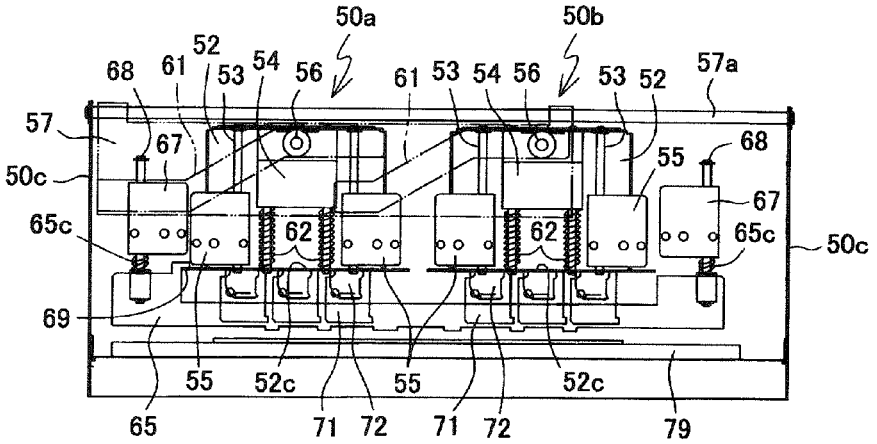
FIGS. 7A to 7C are explanatory views illustrating an operation state of a stamper holder supporting the adhesive tape stamper.

The roller engaged with (fitted into) each cam member 61 is fixed to the moving block 54 through a shaft. Referring to FIG. 7A (which is an explanatory view as viewed from the back of the cam member 57 of FIG. 4), the moving block 54 is slidably supported by inner two guide rods 53 of four guide rods 53 provided in the stamper holder 52 that supports the adhesive tape stamper 51 so as to vertically extend. On the other hand, each of the remaining (outer) two guide rods 53 is slidably supported by a support block 55 fixed to the center support frame 63 connecting the left and right application device frames 50*c*. Accordingly, the stamper holder 52 supporting the adhesive tape stamper 51 is supported by the support block 55 in which the outer guide rods 53 slide.

On the other hand, the moving block 54 is mounted to the two guide rods 53 at a center of the stamper holder 52 so as to be freely slidable. The moving block 54 is fixed to the roller 56 engaged, as a cam follower, with the above cam groove 61. Further, a pressure spring 62 is wound around the center two guide rods 53 between a bottom surface of the moving block 54 and a rear surface 52*c* of a bottom surface of the stamper holder 52. The pressure spring 62 constantly biases the moving block 54 in a direction pressing the same against an upper portion of the stamper holder 52. Accordingly, when the cam member 57 is moved to cause the roller 56 engaged with the cam groove 61 to descend, a transfer head 72 to be described later of the adhesive tape stamper 51 abuts against the paper sheet to stop the descent of the stamper holder 52. Then, the pressure spring 62 is compressed between the bottom surface of the moving block 54 and rear surface 52*c* of the bottom surface of the moving block 54. As a result, the transfer head 72 is pressed more strongly against the paper sheet by an elastic force of the pressure spring 62 compressed by the moving block 54, allowing the adhesive on the transfer tape AT to be reliably applied (transferred) onto the paper sheet.

Further, as illustrated in FIG. 5C, the left and right cam grooves 61 with which the roller 56 is engaged are different in phase and initial position of the roller 56. Thus, the left side roller 56 starts to descend earlier, and the right side roller 56 reaches the lower horizontal cam groove 61*c* later. Therefore, the left side lower horizontal cam groove 61*c* is formed longer than the right side lower horizontal cam groove 61*c*. As a result, the adhesive tape unit 50*a* presses the paper sheet earlier than the adhesive tape unit 50*b*, and the adhesive tape unit 50*b* presses the paper sheet later. A considerable pressing force is required in order for the adhesive tape units 50*a* and 50*b* press the paper sheet at a time, so that a more powerful drive motor needs to be used to move the cam member 57; however, by deviating the timing of pressing the paper sheet as described above, it is possible to reduce a size of the motor or weight of the frame. This further makes it unlikely to generate wrinkles or twist in the paper sheet.

[Bonding Member (Adhesive Tape Stamper)]

The adhesive tape stamper 51 configured to be mountable to the stamper holder 52 constituting the adhesive tape units 50*a* and 50*b* will be described using FIGS. 6A to 6D. FIG. 6A illustrates an outer appearance of the adhesive tape stamper 51. There are shown, in FIG. 6A, a stamper cover 70, a transfer tape AT having an adhesive on a tape base material and configured to be sequentially delivered, a transfer head 72 around which the transfer tape AT is wound and configured to back up the transfer tape AT so as to press the same against the paper sheet, and a sheet pressing slider 71 positioned beside the transfer head 72 and configured to be moved vertically between a position protruding from the transfer head 72 and a retreat position corresponding to the transfer head 72. When the transfer head 72 is moved down and applies/transfers the transfer tape AT onto the paper sheet, the sheet pressing slider 71 presses the paper sheet positioned thereunder. With this pressing operation, the transfer tape AT is delivered, and a new adhesive surface is delivered. The transfer head 72 then backs up and presses the adhesive surface to thereby apply/transfer the adhesive onto the paper sheet.

The following describes a configuration in which extension/contraction of the sheet pressing slider 71 delivers the transfer tape AT. As illustrated in FIG. 6B, there are disposed, inside the stamper cover 70, a supply reel 74 freely rotatable about a supply reel shaft 74*a*, around which an unused transfer tape AT is wound and a winding reel 75 free rotatable about a winding reel shaft 75*a* and configured to wind the transfer tape AT that is delivered from the supply reel 74 and stretched over the transfer head 72. FIG. 6C illustrates a state before the transfer tape AT is delivered from the supply reel 74. Above the sheet pressing slider 71 provided inside the stamper cover 70 so as to be extendable/contractible, a resin slider rack 77 is provided. The slider rack 77 is engaged with a gear rotating together with the winding reel 75. Further, the gear of the winding reel 75 is engaged with a gear rotating together with the supply reel 74 through inter-reel gears 76.

Further, a slider spring 73 is provided in the sheet pressing slider 71 and constantly biases outward (downward in FIGS. 6A to 6D) the sheet pressing slider 71. Thus, when the adhesive tape stamper 51 in a state of FIG. 6D is pressed down in a state of FIG. 6C where the slider spring 73 is extended, the slider spring 73 is compressed. At the same time, the slider rack 77 is engaged with a winding reel gear 75*b* of the winding reel 75 to rotate the winding reel 75 in a clockwise direction in the drawing. The winding reel gear 75*b* is engaged with one of the inter-reel gears 76, and the other one of the inter-reel gears 76 is engaged with a supply reel gear 74*b*. Thus, when the winding reel 75 is rotated in the clockwise direction in the drawing, the supply reel 74 is also rotated to cause the adhesive tape AT to be wound around the winding reel. At the same time, the transfer tape AT is delivered from the supply reel, and a new adhesive surface is positioned at the transfer head 72.

Then, when the adhesive tape stamper 51 is moved up in the state of FIG. 6D, the slider spring 73 is elastically restored to press down the sheet pressing slider 71. At this time, the winding reel gear 75*b* is engaged with the slider rack 77 and is thus rotated in a counterclockwise direction; however, a ratchet mechanism that transmits rotation only in one direction is interposed between the winding reel gear 75*b* and winding reel 75, so that the winding reel 75 is not rotated. Further, the inter-reel gear 76 engaged with the winding reel gear 75*b* and supply reel gear 74*b* are also rotated in the counterclockwise direction; however, a ratchet mechanism that transmits rotation only in one direction is interposed between the supply reel gear 74*b* and supply reel 74, so that the supply reel 74 is not rotated. With this mechanism, only when the sheet pressing slider 71 is pressed down, the supply reel 74 and winding reel 75 are rotated, and a new adhesive surface of the adhesive tape AT is delivered to the transfer head and positioned thereat. In the present embodiment, as the ratchet mechanisms which are not illustrated, a one-way clutch that transmits rotation only in one direction between the reel gear and reel may be adopted.

The movement from the state of FIG. 6C to state of FIG. 6D is made by the cam member 57 vertically moving the stamper holder 52 that supports a plurality of adhesive tape stampers 51. This mechanism is as described above. Note that, as illustrated in FIG. 3, a foamed resin cushion material 52*a* for buffering an impact upon the vertical movement is interposed between the stamper holder 52 and adhesive tape stamper 51. This improves application (transfer) performance of the adhesive from the adhesive tape AT onto the paper sheet.

By the way, the adhesive tape AT in the present embodiment has the adhesive on the tape base material and is configured to press the tape base material against the paper sheet to thereby transfer the adhesive onto the paper sheet.

[Sheet Bundle Presser Adjacent to Stamper Holder]

The following describes, using FIGS. 3 and 4, and particularly FIG. 7A, a sheet presser 65 that prevents movement or flapping of the paper sheet before the sheet pressing slider 71 of the adhesive tape stamper 51 described using FIGS. 6A to 6D presses the paper sheet against the platen 79 as the bonding position.

As described above, the sheet presser 65 for regulating the paper sheet stopped at the bonding position for bonding is mounted to the adhesive application device 50 so as to be vertically movable with respect to the platen 79. As illustrated in FIG. 7A, there is provided, on both side of the two stamper holders 52 each supporting the adhesive tape stampers 51, a sheet presser support block 67 that slidably supports a sheet presser guide rod 68 having the sheet presser 65. The sheet presser support block 67 is fixed to the center support frame 63 by screws or the like inserted into round holes formed therein. Further, a pressing pressure spring 65*c* wound around the sheet presser guide rod 68 is provided at both side ends of the sheet presser support block 67 and a side edge presser 65*a* of the sheet presser 65.

The sheet presser 65 is constantly biased in a direction pressing the paper sheet, and one (left side of FIGS. 7A to 7C) stamper holder 52 and sheet presser 65 are engaged with each other through an engagement portion 69 to stop the sheet presser 65 at a position separated from the paper sheet on the platen 79. Thus, when the stamper holder 52 is not moved down with the movement of the cam member 57, the sheet presser 65 stays at the position separating from the paper sheet, allowing passage of the paper sheet. When the stamper holder 52 starts being moved down toward the paper sheet with the movement of the cam member 57, the engagement portion between the stamper holder 52 and sheet presser 65 is moved down as illustrated in FIG. 7C, and the sheet presser 65 is moved down to prevents displacement or flapping of the paper sheet on the platen 79. This can prevents the displacement or flapping of the paper sheet when the stamper holder 52 is moved down to cause the sheet pressing slider 71 to press the paper sheet, or when the stamper holder 52 is further moved down to cause the transfer head 72 supporting the adhesive tape AT and pressing the same against the paper sheet to press the paper sheet.

Figure 7B:
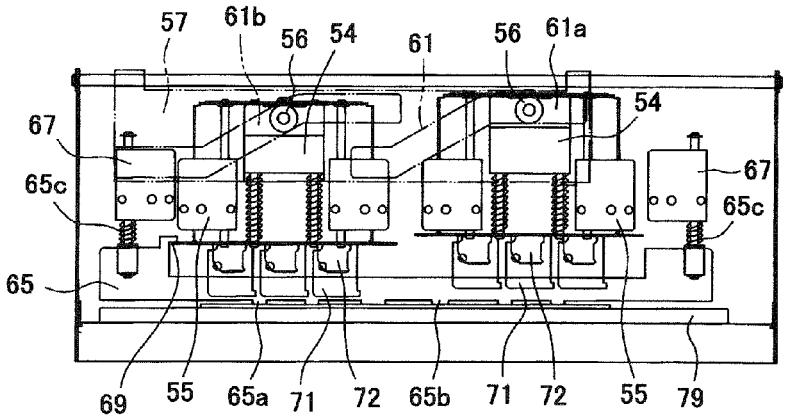
Figure 7C:
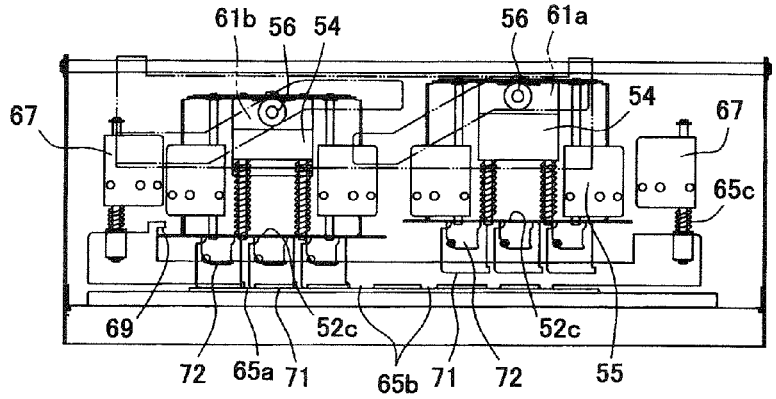

After each adhesive tape stamper 51 applies (transfers) the adhesive of the adhesive tape AT onto the paper sheet in the width direction thereof with the moving down of the two stamper holders 52, when the cam member is returned to a state of FIG. 7B, the engagement portion of the sheet presser 65 is engaged with the stamper holder 52 and moved up to a position retreated from the paper sheet by moving up of the stamper holder 52. As described above, the sheet presser 65 presses the paper sheet, interlocking with the vertical movement of the stamper holder 52, before other members do. This sheet presser may be moved down before the moving down of the stamper holder 52 by means of a solenoid or the like. Further, although the side edge presser 65*a* and a center presser 65*b* are provided so as to press the paper sheet over the entire width thereof, only one of them suffices. That is, it is only necessary to prevent the paper sheet from being moved before application of the adhesive.

[Operation of Adhesive Application Device]

The following describes an operation of applying (transferring) the adhesive onto the paper sheet by the adhesive application device 50 using FIGS. 7A to 7C and FIGS. 8A to 8C. FIGS. 7A to 7C and FIGS. 8A to 8C are each an explanatory view as viewed from the back of the cam member 57.

In a state of FIG. 7A, the cam member 57 is situated at an initial position, and the moving block 54 that makes the stamper holder 52 mounted with the adhesive tape stampers 51 slide along the inner guide rods 53 and roller 56 are engaged with the cam groove 61 of the cam member 57. As described above, the moving block 54 has the pressure spring 62 which is interposed between itself and the moving block 54 and brings the pressure spring 62 into contact with and presses the rear surface 52*c* of the stamper holder 52, as illustrated in FIG. 7A. Further, the stamper holder 52 is configured to slide along the outside guide rods 53 slidably supported by the support block 55 fixed to the center support frame 63 connecting the left and right application device frames 50*c* so as to be moved vertically.

In FIG. 7A, the stamper holder 52 and the sheet presser 65 locked to the stamper holder 52 are separated from the platen 79, thereby maintaining a space for allowing passage of the paper sheet. In this state, the sheet pressing slider 71 and transfer head 72 of each adhesive tape stamper 51 are situated at a position farthest from the paper sheet. The other stamper holder 52 is situated at the same position.

In FIG. 7B, the paper sheet is situated at the bonding position, and the cam moving motor 60 is driven by a signal for commanding application of the adhesive tape AT to move the cam member 57 to the right in the drawing. Then, the roller 56 on the left side in the drawing starts being moved down along the inclined cam groove 61*b*. This movement causes the left side stamper holder 52 to be moved down with the support block 55 sliding along the guide rods 53. The moving down of the stamper holder 52 causes the engagement portion 69 engaged with the stamper holder 52 to be moved down, thereby starting pressing the paper sheet on the platen 79. On the other hand, the sheet pressing slider 71 and transfer head 72 of each adhesive tape stamper 51 are also moved down, but do not contact the paper sheet. The stamper holder 52 on the right side in the drawing is not moved down since the roller 56 is only slid in the upper horizontal cam groove 61*a* of the cam groove 61.

When the cam member 57 is further moved, the roller 56 on the left side in the drawing is further slid down along the inclined cam groove as illustrated in FIG. 7C. This sliding down releases the engagement between the sheet presser 65 and right side stamper holder 52 which are engaged with each other at the engagement portion 69. When the engagement is released, the sheet presser 65 presses the paper sheet more reliably for position regulation by means of the pressing pressure spring 65*c* interposed between itself and sheet presser support block 67. On the other hand, the sheet pressing slider 71 of the adhesive tape stamper 51 starts to contact the paper sheet. With this contact, the adhesive tape AT is moved from the state of FIG. 6C to state of FIG. 6D to expose a new adhesive surface. In this state, the transfer head 72 has not yet contact the paper sheet. The stamper holder 52 on the right side in the drawing is not moved down since the roller 56 is only slid in the upper horizontal cam groove 61*a* of the cam groove 61.

Figure 8A:
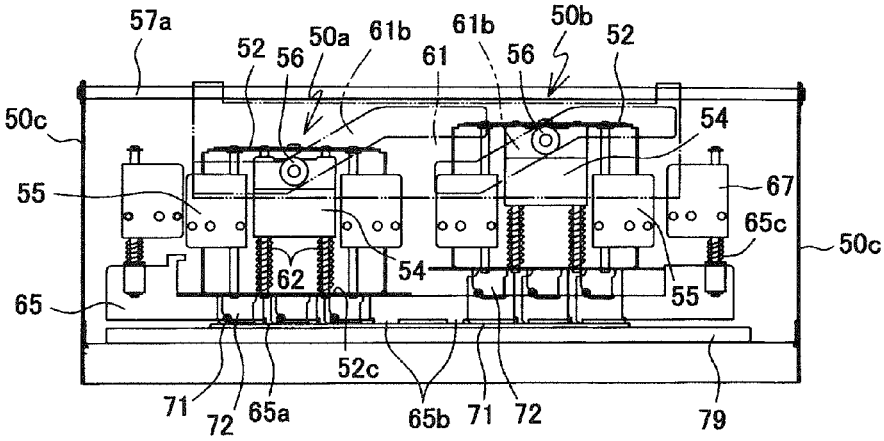
FIGS. 8A to 8C are explanatory views, continued from FIG. 7C, illustrating the operation state of a stamper holder supporting the adhesive tape stamper.

Subsequently, when the cam member 57 is moved to the right as illustrated in FIG. 8A, the stamper holder on the left side in the drawing is moved down to cause the sheet pressing slider 71 and transfer head 72 to abut against the paper sheet. When the transfer head 72 abuts against the paper sheet, the moving down of the stamper holder 52 is stopped, while the moving block 54 is slid along the inclined cam groove 61*b* and moved down. With this movement, the pressure spring 62 starts being compressed, and the elastic force of the pressure spring 62 acts on the transfer head 72 through the stamper holder 52 as a pressurizing force, with the result that the adhesive tape AT is pressed against the paper sheet more strongly. Thus, the adhesive can be reliably applied/transferred onto the paper sheet.

On the other hand, the roller 56 of the right side stamper holder 52 starts being slid down along the inclined cam groove 61*b*, and the sheet pressing slider 71 of the adhesive tape stamper 51 of the right side stamper holder 52 starts pressing the paper sheet.

Figure 8B:
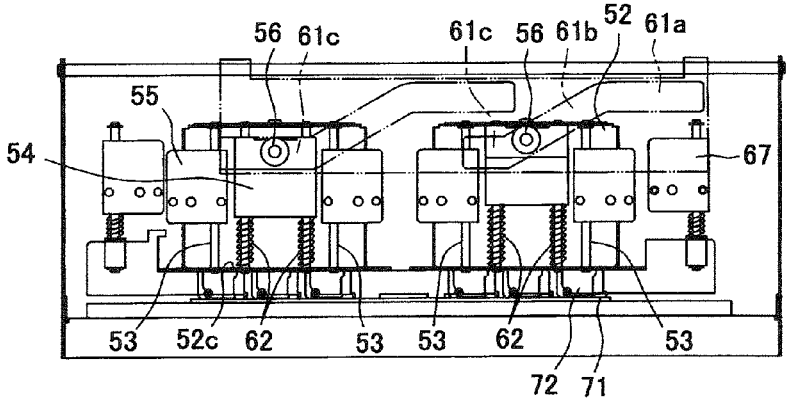

When the cam member 57 is further moved, a state of FIG. 8B is reached. In this state, the stamper holder 52 on the left side in the drawing is maintained in a pressurized state by the elastic force of the pressure spring 62. On the other hand, the roller 56 of the stamper holder 52 on the right side in the drawing reaches an end point of the inclined cam groove 61*b*, with the result that the sheet pressing slider 71 and transfer head 72 of the adhesive tape stamper 51 of the right side stamper holder 52 press the paper sheet.

Figure 8C:
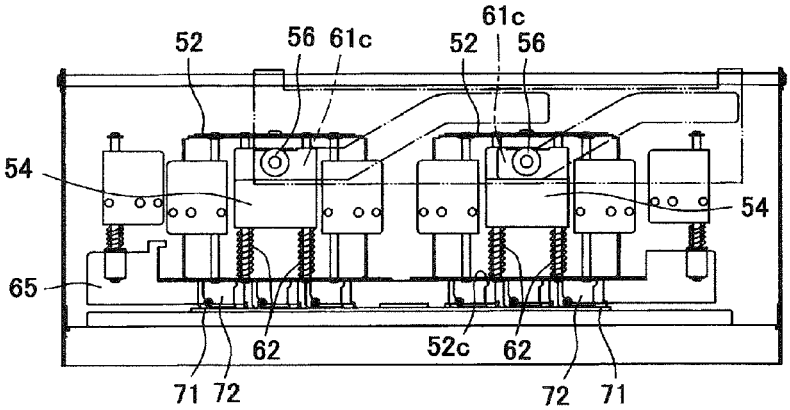

When the cam member 57 is situated at the rightmost position as illustrated in FIG. 8C, the left side stamper holder 52 is maintained in a more pressurized state by the elastic force of the pressure spring 62. On the other hand, the roller 56 of the stamper holder 52 on the right side in the drawing reaches the lower horizontal cam groove 61*c*, with the result that the sheet pressing slider 71 and transfer head 72 of the adhesive tape stamper 51 of the stamper holder 52 on the left side press the paper sheet and that the pressure spring 62 is compressed. This elastic force acts on the transfer head 72 through the stamper holder 52 as a pressurizing force, with the result that the adhesive tape AT is pressed against the paper sheet more strongly. Thus, the adhesive can be reliably applied (transferred) onto the paper sheet.

After all the transfer heads 72 of the left- and right-side stamper holders 52 have applied the adhesive onto the paper sheet by the moving down of the left- and right-side stamper holders 52, the cam member 57 is moved to the left in the drawing to move up the stamper holder 52 in a reverse order of the moving-down procedure. When the state of FIG. 7B is reached, the stamper holder 52 on the left side is engaged with the engagement portion 69 of the sheet presser 65 to move the sheet presser 65 to a position separated from the paper sheet. Subsequently, the state of FIG. 7A is restored, and the application of the adhesive onto a next paper sheet is prepared for.

As described above, in the present embodiment, the paper sheet is previously pressed by the sheet presser 65 to prevent movement of the paper sheet before the transfer head 72 of the adhesive tape stamper 51 applies the adhesive onto the paper sheet. This prevents displacement or flapping of the paper sheet, thus making it possible to apply the adhesive onto a predetermined position on the paper sheet. Further, even after the transfer head 72 abuts against the paper sheet, the stamper holder 52 that supports the transfer head 72 is pressed by the pressure spring 62. This makes it possible to press the transfer head 72 against the paper sheet more strongly, allowing the adhesive on the adhesive tape AT to be reliably transferred onto the paper sheet.

Further, as described in the explanation of the operation of the adhesive application device, the left and right stamper holders 52 illustrated in FIGS. 7 and 8 do not press the transfer heads 72 simultaneously, but the timing of pressing the paper sheet is deviated such that first the left side transfer head 72 group is pressed against the paper sheet, and then the right side transfer head 72 group is pressed against the paper sheet while the pressuring state of the left side transfer head 72 group is maintained. Thus, it is possible to reduce a drive force as compared to a case where the both the left- and right-side transfer head 72 groups are pressed against the paper sheet at a time, which in turn can reduce a size of the cam moving motor 60. Further, the device can be formed even with a slightly brittle frame structure, allowing a reduction in weight of the device.

The following sequentially describes the sheet side edge aligning member 48 positioned inside the stacker section 40 at a downstream side of the adhesive application device 50, conveying roller 46 and pressure roller 49 which are configured to be separated from the paper sheet during the aligning operation, stopper section 90 that regulates a leading end of the paper sheet carried into the stacker section 40, and gripper 91 provided in the stopper section 90 and configured to grip the paper sheet.

[Sheet Side Edge Aligning Mechanism]

Figure 9:
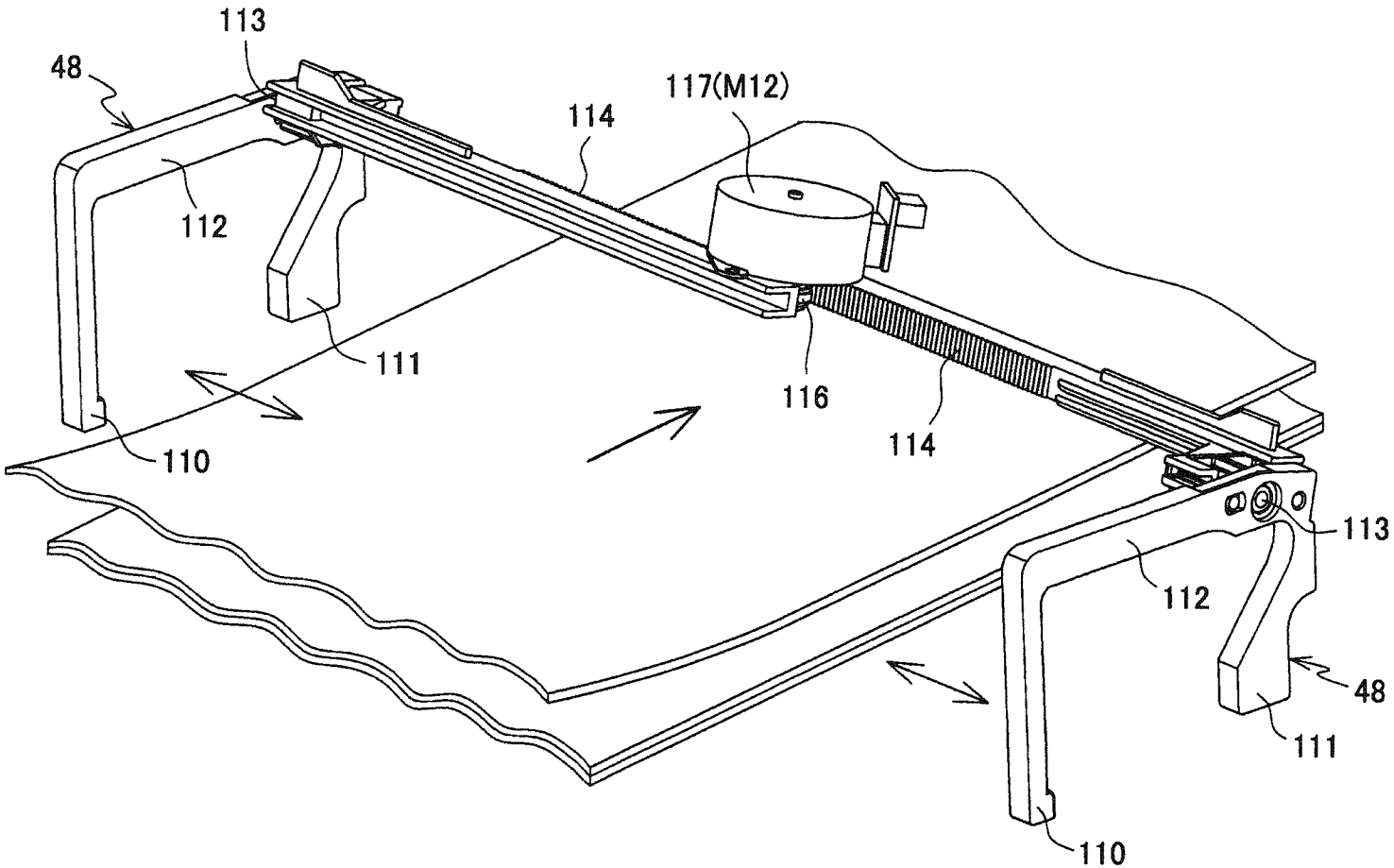
FIG. 9 is a perspective view of a sheet side edge aligning member disposed in a stacker section.

As described above, the sheet side edge aligning member 48 configured to be moved in the sheet width direction to press a side edge of the paper sheet in the stacker section 40 is disposed on both sides of the downstream side of the adhesive application device 50. A configuration of the sheet side edge aligning member 48 will be described more in detail using FIG. 9. The sheet side edge aligning member 48 includes, on both sides of the sheet width direction, an upstream side aligning plate 110 positioned at an upstream side in the sheet conveying direction, a downstream side aligning plate 111 positioned at a downstream side in the sheet conveying direction relative to the upstream side aligning plate 110, and an aligning plate connecting portion 112 connecting the upstream- and downstream-side aligning plates 110 and 111. An interval between the downstream side aligning plates 111 in the sheet width direction is slightly wider than that between the upstream side aligning plates 110. Racks 114 extending in the sheet width direction are fixed respectively to the left and right aligning plate connecting portions 112 at their rack connecting portions 113. A pinion 116 meshed with rack teeth is provided at a center of the left and right racks 114 and is connected to an aligning motor 117 (M12). The pinion 116 is rotated by forward/backward rotation of the aligning motor 117, and the upstream side aligning plate 110 and downstream side aligning plate 111 are reciprocated in the sheet width direction by the rack 114 meshed with the pinion 116. As a result, side edges of the paper sheet are pressed for alignment.

Drive/rotation of the above aligning motor 117 is controlled by a sheet binding/bonding operation controller 201 to be described later. In the present embodiment, an application position at which the adhesive is applied onto the paper sheet for bonding is retreated to the retreat path 47. This allows a new paper sheet to be bonded to be positioned in the carry-in path 41. That is, it is possible to align the new and preceding paper sheets in a state where the leading ends thereof whose rear ends are positioned in the different paths (carry-in path 41 and retreat path 47) abut against the stopper section 90. Further, the sheet side edge aligning member 48 is positioned at this position, allowing the alignment processing to be performed immediately before the bonding between the paper sheet on a surface of which the adhesive has been applied and a next paper sheet, which improves alignment accuracy of the paper sheet to be bonded.

[Separating Mechanism (Conveying Roller, Etc.)]

Figure 10A:
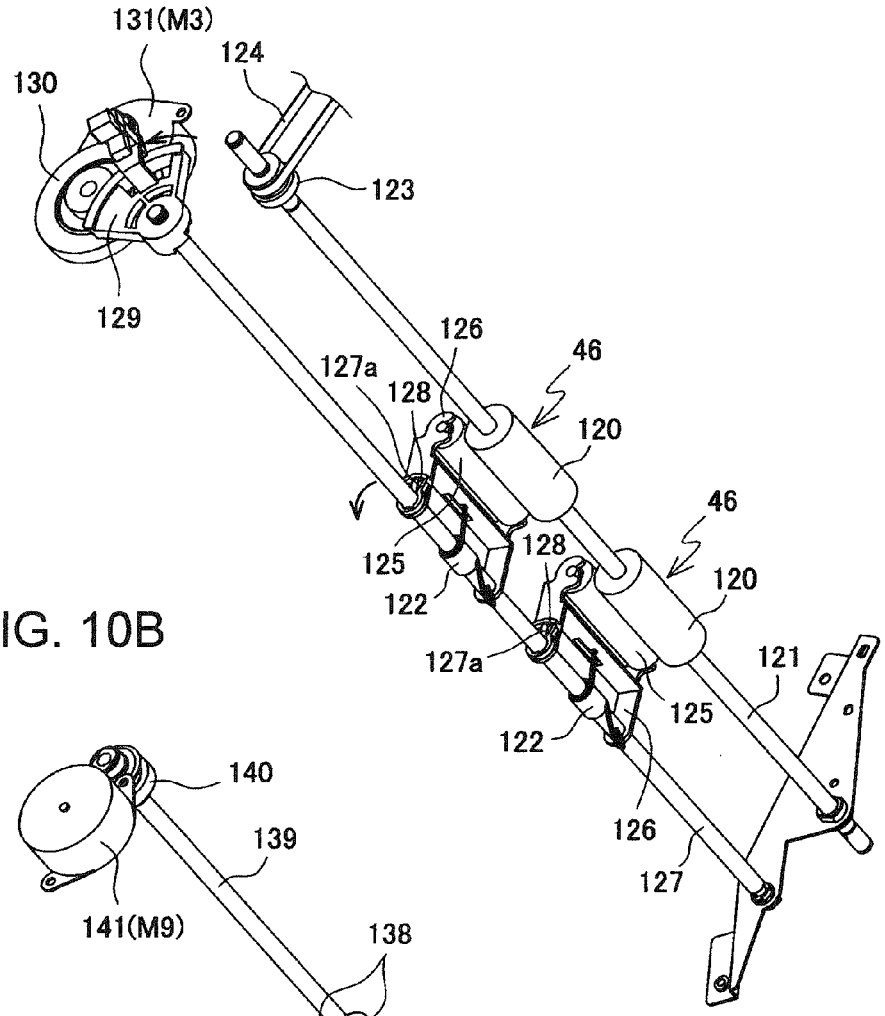
FIG. 10A illustrates contact and separation of a pinch roller in a sheet carry-in path with respect to a drive roller.
Figure 10B:
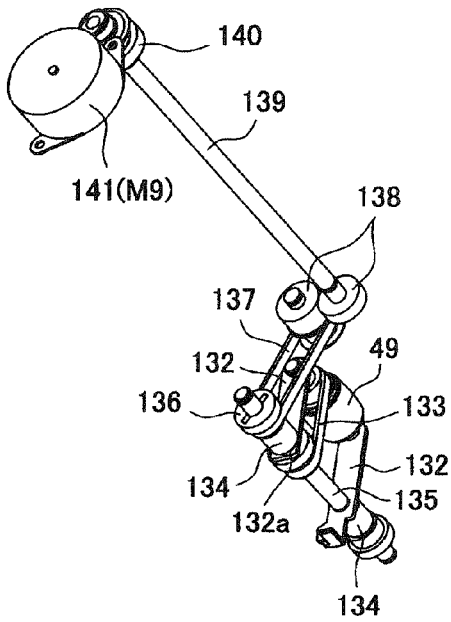
FIG. 10B illustrates a pressure roller configured to press and separate from the paper sheet in the stacker section.

It is necessary to release nipping and pressure contact with the paper sheet upon the alignment operation of the sheet side edge aligning member 48. This mechanism will be described using FIGS. 10A and 10B. FIG. 10A illustrates a nipping and nipping release configuration of the conveying roller 46 positioned at the downstream side of the carry-in path 41. FIG. 10B illustrates a pressure contact separating configuration of the pressure roller 49 which is positioned in the middle of the stacker section 40 and straight downstream of the folding section 80 and configured to press the paper sheet against the stacker lower guide 40*b* and apply a conveying force in a direction toward the stopper section 90 side.

First, the conveying roller 46 of FIG. 10A will be described. The conveying roller 46 is rotated by a roller transmission belt 124 that receives a drive force from a forward/backward rotation conveying motor M2 includes a drive roller shaft 121, a drive roller 120, and a pinch roller 125 configured to contact and separated from the drive roller 120. Release of the nipping of the conveying roller 46 is made by separation of the pinch roller 125 from the drive roller 120. The pinch roller 125 includes a support bracket 126 supporting the pinch roller 125 and a turning shaft 127 that turnably support the support bracket 126. The turning shaft 127 is fixed to a turning gear 129 at a device base end portion. The turning gear 129 is engaged with a separating motor 131 (M3) through a separating motor gear 130. A protruding pin 127*a* whose lower end side is embedded in the turning shaft 127 and whose upper end protrudes from the turning shaft 127 is engaged with a pin receiving groove 128 of the support bracket 126. The pin receiving groove 128 is configured to allow the protruding pin 127*a* to be freely moved in a predetermined range. Further, a coil spring 122 wound around the turning shaft 127 is bridged between the support bracket 126 and a not illustrated device frame.

Thus, the coil spring 122 causes the pinch roller 125 to be constantly biased by the drive roller 120 and thereby applies a conveying force to the paper sheet. On the other hand, when a signal commanding separation of the pinch roller 125 from the drive roller 120 is output from a sheet conveying controller 195 upon operation of the sheet side edge aligning member 48, the separating motor 131 for the pinch roller 125 is driven. The drive of the separating motor 131 causes the turning gear 129 fixed to the turning shaft to be rotated in a direction denoted by an arrow of FIG. 10A through the separating motor gear 130. The rotation of the turning gear 129 causes the protruding pin 127*a* on the turning shaft 127 to be rotated in the pin receiving groove 128 in a direction denoted by an arrow of FIG. 10A. Then, when the protruding pin 127*a* abuts against a protruding wall of the pin receiving groove 128, the support bracket 126 is moved to separate the pinch roller 125 from the drive roller 120, thereby releasing the nip with the paper sheet. Conversely, in order to bring the pinch roller 125 into pressure contact with the drive roller 120 for the sheet conveyance, the separating motor 131 is reversed. Then, the protruding pin 127*a* is positioned at a substantial center of the pin receiving groove 128. Thus, the elastic force of the coil spring 122 causes the pinch roller 125 to be brought into pressure contact with the drive motor, whereby a constant conveying force can be applied to the paper sheet.

FIG. 10B illustrates the pressure roller 49 configured to be movable so as to contact and separate from the stacker lower guide 40*b* of the stacker section 40. The pressure roller 49 is separated from the stacker lower guide 40*b* until the lead end of the paper sheet passes therethrough and is rotated so as to press the paper sheet against the stacker lower guide 40*b* after the leading end passes therethrough. The illustrated pressure roller 49 is provided at a substantial center in the sheet width direction. The pressure roller 49 is supported by a support arm 132 connected thereto on both sides thereof and is configured to be lifted or lowered by a spring clutch 134 wound between an intermediate shaft holder 136 and an arm holder 132*a* which are fixed to an intermediate shaft 135. Turning of the intermediate shaft 135 is transmitted to the pressure roller 49 through a pressure roller transmission belt 133, whereby the pressure roller 49 is driven. The turning drive of the intermediate shaft 135 is made by an intermediate transmission belt 137, an intermediate gear 138, a drive shaft 139 for driving the intermediate gear 138, and a motor transmission belt 140 wounded between the drive shaft 139 and a pressure roller nip/separation motor 141 (M9) for turning the drive shaft 139.

When passing of the leading end of the paper sheet through the pressure roller 49 is detected in the stacker section and, then, the pressure roller nip/separation motor 141 is forward rotated by a stacker section storage operation controller 200, the intermediate shaft holder 136 is rotated in the forward direction. The rotation in this direction loosen the spring clutch 134 to cause the arm holder 132*a* to be released from regulation, with the result that the pressure roller 49 is brought into pressure contact with the paper sheet by its own weight. While the pressure roller 49 is brought into pressure contact with the paper sheet, a torque for feeding the paper sheet to the downstream side is applied to the paper sheet, whereby the paper sheet is conveyed toward the illustrated stopper section 90.

On the other hand, when the paper sheet entering the stacker section 40 is aligned or when the paper sheet is conveyed to the upstream side (e.g., in the switchback conveying direction toward the retreat path 47), the pressure roller nip/separation motor 141 is backward rotated to tighten the spring clutch 134 to lift the pressure roller 49. Even when the pressure roller nip/separation motor 141 is stopped in this state, the pressure roller 49 is retained at a retreat position separated from the paper sheet by the motor torque and spring clutch. The pressure roller 49 may be lifted and lowered by a solenoid or the like directly connected thereto.

[Stopper Section Gripper Opening/Closing Mechanism]

Figure 11B:
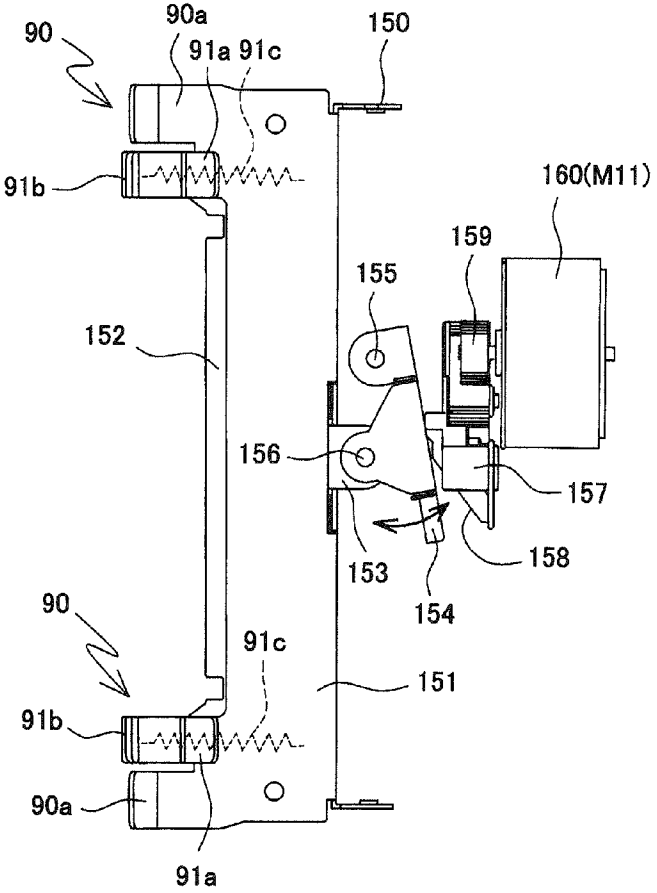
FIG. 11B is a plan view of the stopper section and gripper.
Figure 11A:
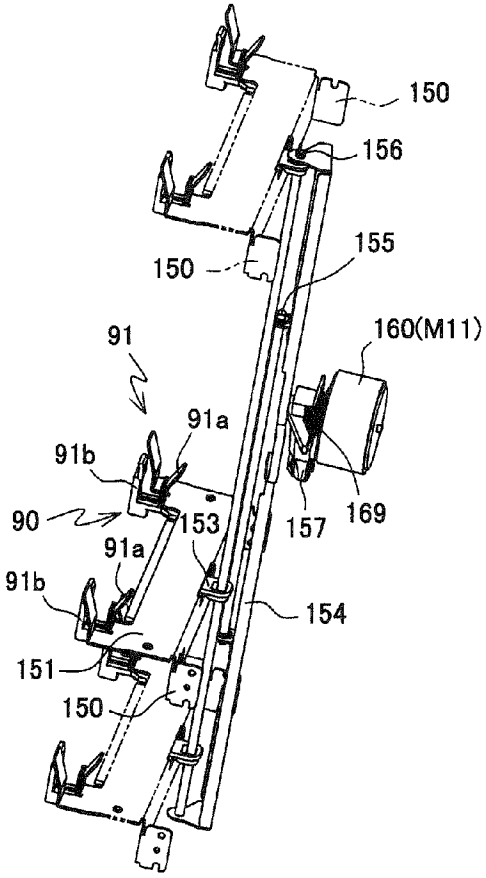
FIG. 11A is an explanatory view of a stopper section moved vertically in the stacker section and a gripper.

With reference to FIGS. 11A and 11B, a closing state where the gripper 91 positioned at a leading end of the stopper section 90 grips the paper sheet and an opening state where the gripping of the paper sheet by the gripper 91 is released will be described. The vertical movement of the stopper section 90 has already been described, so description thereof will be omitted here.

FIG. 11A illustrates the entire moving range of the gripper 91, in which the gripper 91 at the uppermost and lowermost positions is denoted by a virtual line. FIG. 11B is a plan view illustrating the gripper 91 and stopper section 90 as viewed from above. The gripper 91 is disposed at the leading end of the stopper section 90, and a moving piece 91*b* of the gripper 91 is separated from a fixed piece 91*a* of the stopper section 90. A gripper connecting portion 152 connecting the moving pieces 91*b* is disposed below the stopper section 90 and a stopper section connecting portion 151 so as to be overlapped therewith and to freely advance and retreat with respect thereto. Further, a closing spring 91*c* constantly biasing the moving piece 91*b* in a closing direction is provided below the moving piece 91*b*.

The gripper connecting portion 152 has a connecting arm 153 protruding rearward from the stopper section 90. The connecting arm 153 has an opening hole. A turning bracket 154 supporting upper and lower portions of a turning bar 156 penetrating the opening hole of the connecting arm 153 is provided. The turning bracket 154 is turned in a direction denoted by an arrow of FIG. 11B about a turning support point 155. The turning bracket 154 has a turning cam 157 having a bracket pressing surface 158. The turning cam 157 is rotated by a gripper opening/closing motor 160 (M11). When the bracket pressing surface 158 presses the turning bracket 154 with the rotation of the turning cam 157, the turning bracket 154 swings about the turning support point 155. With this swing, the turning bar 156 whose upper and lower portions are supported by the turning bracket 154 advances/retreats. Since the turning bar 156 penetrates the opening hole of the connecting arm 153, the moving piece 91*b* at the leading end of the connecting arm 153 contacts and separates from the fixed piece 91*a* of the stopper section 90.

Further, as illustrated in FIG. 11A, the turning bar 156 is positioned in the vertical movement range of the stopper section 90, so that even when the stopper section 90 is moved vertically, the above connecting arm 153 can make the moving piece 91*b* constituting the gripper 91 at any vertical position. Thus, the closing state where the gripper 91 grips the paper sheet by the turning of the gripper opening/closing motor 160 and opening state where the gripping of the paper sheet is released are realized by the stacker section storage controller 200. As illustrated in FIG. 11A, the stacker section 40 is disposed in an inclined manner, so that the turning bracket 154 is constantly brought into abutment against the turning cam 157. The turning bracket 154 may be brought into abutment against the turning cam 157 by a spring or the like.

[Sheet Bundle Generation Operation by Bonding]

The following sequentially describes a generation operation of a paper sheet bundle obtained by applying the adhesive onto the paper sheet conveyed from the image forming device A by means of the adhesive application device 50 in the stacker section 40 and bonding the paper sheets to each other with reference to FIGS. 12A to 19.

First, in the image forming device, the paper sheets discharged from the main body discharge port 3 are aligned in a bundle, and then the "bonded paper sheet bundle folding mode" in which the paper sheets are bonded, folded in a booklet form, and stored on the second sheet discharge tray 22 is instructed.

Figure 12B:
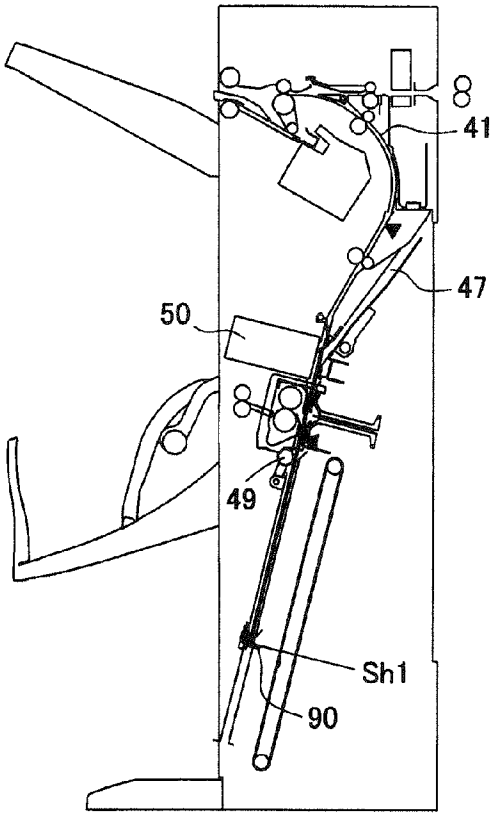
Figure 12A:
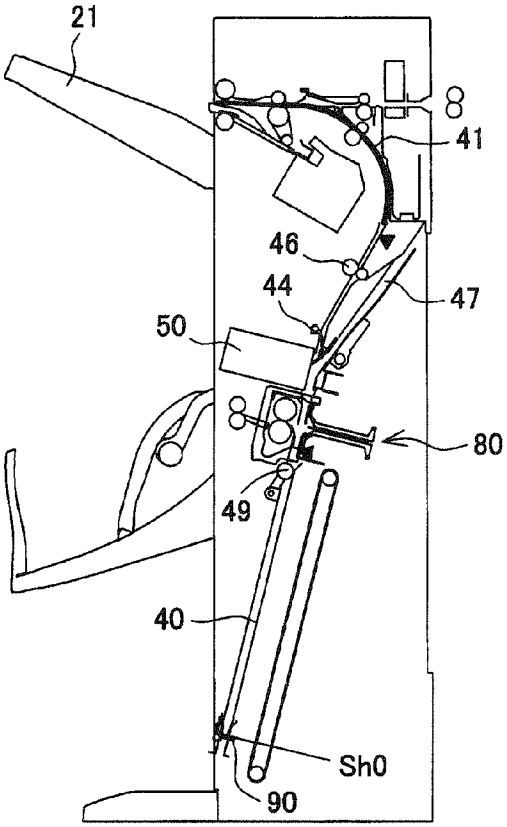

Then, as illustrated in FIG. 12A, a first paper sheet onto which an image has been formed is discharged from the main body discharge port 3 of the image forming device A, passed through the sheet carry-in path P1 and first switchback conveying path SP1 of the sheet processing device (FIG. 2), and conveyed along the carry-in path 41 serving as the second switchback path SP2 by means of the path carry-in roller 45 and conveying roller 46. At this time, the stopper section 90 for regulating the leading end of the paper sheet to be carried into the stacker section 40 is moved from the illustrated initial home position Sh0 to the sheet (bundle) rear end branching point passing position Sh1 at which the rear end of the paper sheet whose leading end abutting with the stopper section 90 is situated at a branching position between the carry-in path 41 and retreat path 47 and stands by there.

FIG. 12B illustrates a state where the rear end of the paper sheet carried into the stacker section 40 is situated at the above branching position. The paper sheet to be conveyed to this position is conveyed until it abuts against the stopper section 90 standing by at the sheet (bundle) rear end branching point passing position Sh1. During the conveyance, the paper sheet is conveyed with the sheet leading end pushing up the deflection guide 44 positioned near the exit of the carry-in path 41. Thereafter, after the leading end of the paper sheet passes through the pressure roller 49, the pressure roller 49 is moved to a position pressing the paper sheet so as to convey the paper sheet to the stopper section 90. The gripper 91 disposed at the leading end of the stopper section 90 is situated at a position at which the gripping of the paper sheet is released so as to receive the paper sheet in a state where the moving piece 91*b* is separated from the fixed piece 91*a*. At a time point when the leading end of the paper sheet abuts against the stopper section 90, the rear end of the paper sheet is situated at the branching position and directed to the retreat path 47 constituting the third switchback path SP3 by the deflection guide 44.

Figure 13B:
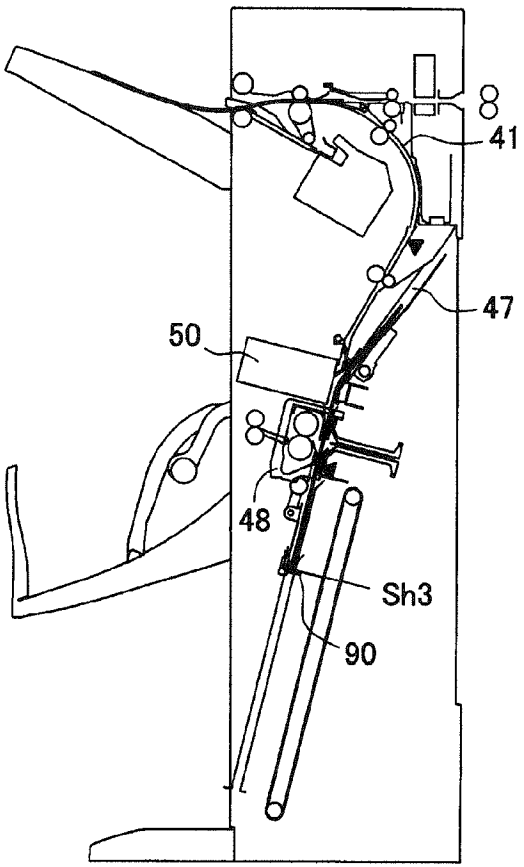
Figure 13A:
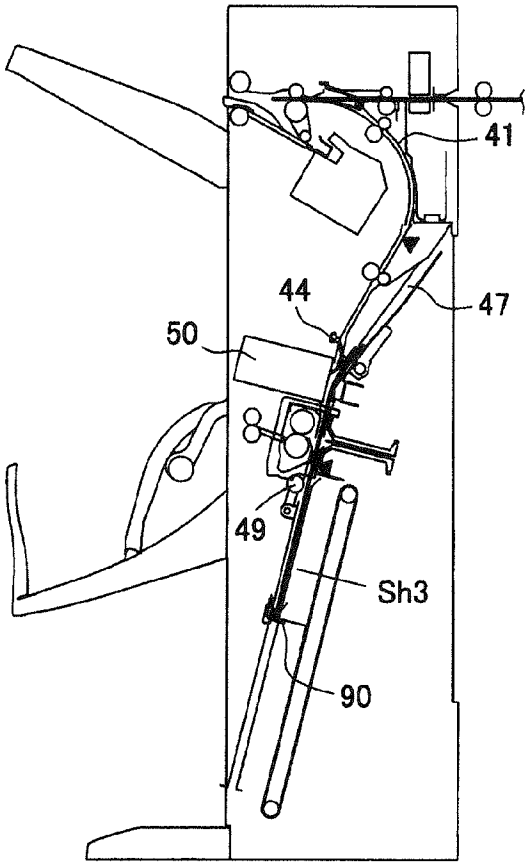

FIG. 13A illustrates a state where the stopper section 90 gripping the paper sheet by means of the gripper 91 at a time point when the rear end of the sheet passes through the branching position is moved up. In this case, the rear end of the paper sheet is directed to the retreat path 47 by the deflection guide 44, so that the paper sheet is switchback-conveyed along the retreat path. At this time, a second paper sheet is carried into the sheet carry-in path P1.

FIG. 13B illustrates a state where the movement of the first paper sheet by the stopper section 90 is stopped at the adhesive tape transfer position Sh3 at which a half position of the paper sheet in the sheet conveying direction is situated at the application position (sheet pressing position of the adhesive tape stamper 51) of the adhesive application device 50. At this timing, the width direction side edges of the paper sheets in a stopped state are tapped by the sheet side edge aligning member 48 disposed adjacent to the adhesive application device 50 for position alignment. After completion of the alignment operation, the cam moving motor 60 of the adhesive application device 50 is driven to move each adhesive tape stamper toward the paper sheet. Then, the paper sheet is pressed first by the sheet presser 65 and then by the sheet pressing slider 71. After that, the transfer head 72 is pressed against the paper sheet to apply the adhesive on the adhesive tape AT onto the paper sheet. After the application, the above members pressing the paper sheet are separated from the paper sheet. During the application, the gripper 91 grips the leading end of the paper sheet.

Figure 14B:
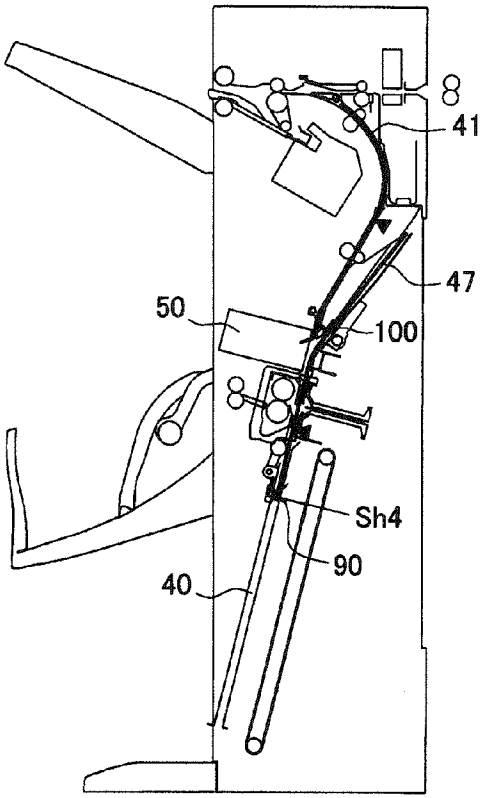
Figure 14A:
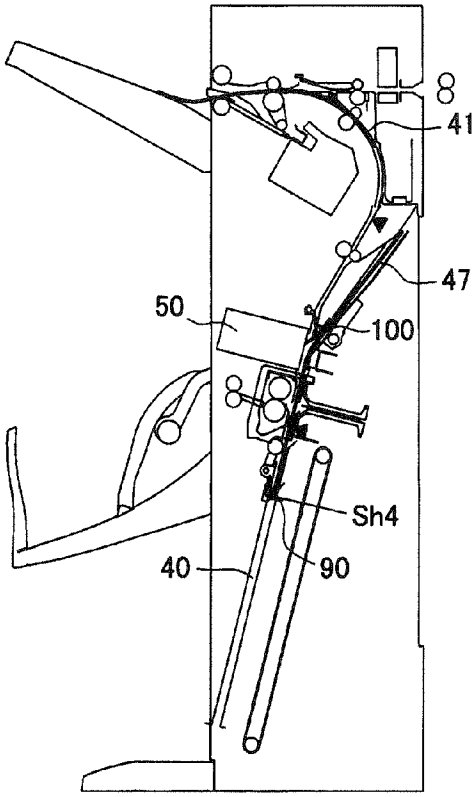

FIG. 14A illustrates a state where the stopper section 90 is moved, after separation of the transfer head 72, sheet pressing slider 71, and sheet presser 65 from the paper sheet, to the adhesive tape concealing position (next sheet receiving position) Sh4 at which the adhesive-applied portion of the paper sheet is retreated to the retreat path 47 so as to prevent the adhesive-applied position from interfering with conveyance of the next paper sheet. The application position is subjected to switchback conveyance by about 35 mm from the above bonding position and thus situated in the retreat path (position 100 in the drawing). The above moving distance is desirably set as small as possible so as not to allow the adhesive-applied position to be adhered to the conveying guide or deflection guide 44. Further, a member contacting the paper sheet, such as the deflection guide 44, is disposed between adhesive lines. After movement of the application position of the preceding paper sheet to the retreat position (position 100 in the drawing), the moving piece 91*b* is separated from the fixed piece 91*a* so as to release the gripping of the paper sheet by the gripper 91 which grips the paper sheet during the application and movement of the application position.

In a state where the gripping state of the paper sheet by the gripper 91 is released, a next paper sheet is moved along the carry-in path 41 as illustrated in FIG. 14B to be carried into the stacker section 40. In this state, the application position of the preceding paper sheet is retreated to the retreat path and concealed, so that the next paper sheet can be carried in on the preceding paper sheet without any trouble. The stopper section 90 stands by for carry-in of the next paper sheet at the adhesive tape concealing position (next sheet receiving position/position 100 in the drawing) Sh4.

Figure 15B:
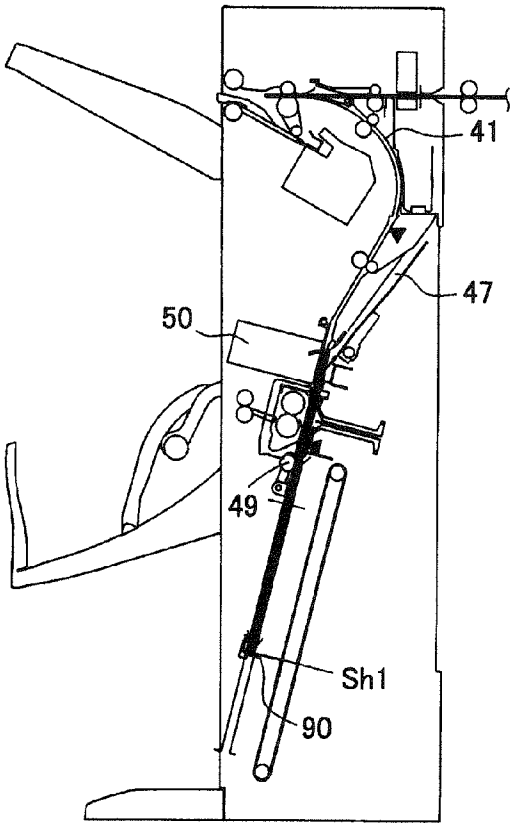
Figure 15A:
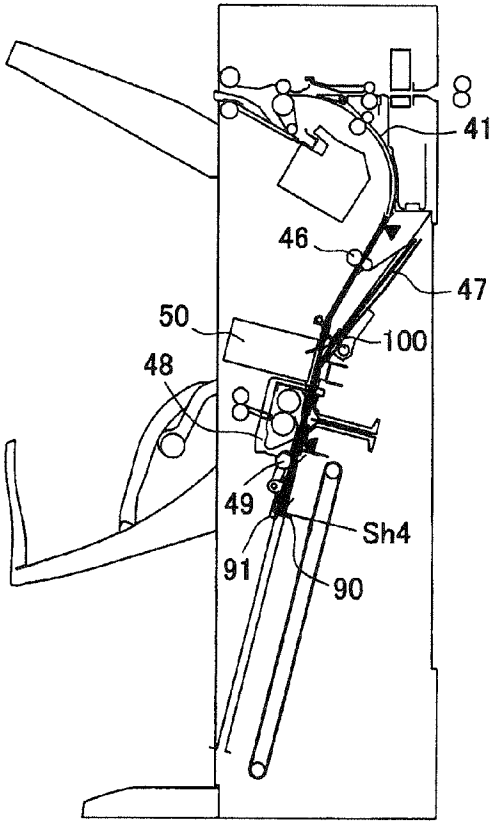

FIG. 15A illustrates a state where the stopper section 90 receives the leading end of the next paper sheet at the adhesive tape concealing position (next sheet receiving position/position 100 in the drawing) Sh4. In this state, the rear end of the preceding paper sheet (including the application position thereof) is situated in the retreat path 47, and rear end of the next paper sheet is situated in the carry-in path 41. Further, the leading ends of both the preceding and next paper sheets abut against the stopper section 90. The pressure roller 49 is lowered so as to be brought into pressure contact with the next paper sheet when the leading end of the next paper sheet passes through the pressure roller 49 and applies a conveying force to the next paper sheet. After the preceding and next paper sheets abut against the stopper section 90, the sheet side edge aligning member 48 is activated so as to align both the paper sheets. Prior to this alignment operation, nipping of the conveying roller 46 positioned in the carry-in path 41 is released, and the pressure roller 49 is separated from the paper sheet. Thereafter, the side edges of both the paper sheets overlapped with each other with the rear ends thereof positioned in the different paths (carry-in path 41 and retreat path 47) are pressed by the sheet side edge aligning member 48 for alignment. In the present embodiment, the pressing is performed twice. During the alignment operation, the gripper 91 is in an opened state where the gripping of the paper sheet is released.

As illustrated in FIG. 15B, after the above alignment operation, the conveying roller 46 in the carry-in path 41 is made to nip the paper sheets, and the pressure roller 49 is pressed against the paper sheets. Further, the gripper 91 is made to grip the paper sheets. In this state, the stopper section 90 is moved down to the sheet (bundle) rear end branching point passing position Sh1 at which the rear end of the second (next) paper sheet passes through the branching position. With this operation, the adhesive-applied position of the first (preceding) paper sheet passes through the pressure roller 49, and thus the bonding to the next sheet is achieved to some extent. At this time, a third paper sheet is being carried into the sheet carry-in path P1.

Figure 16B:
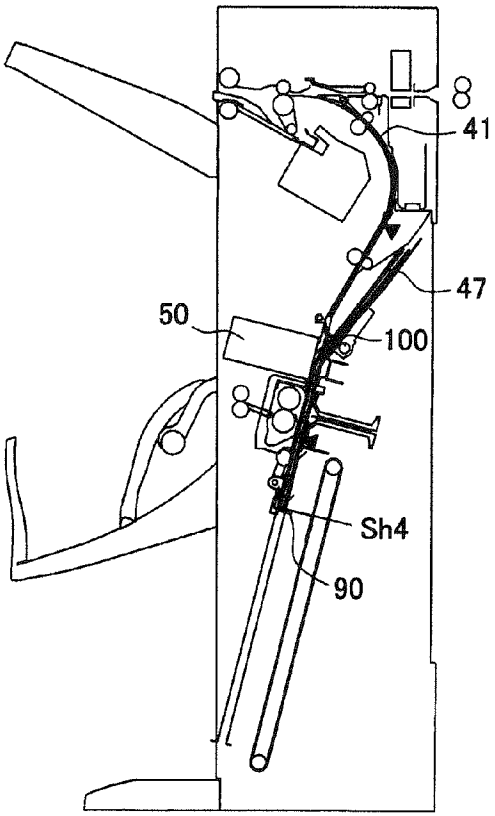
Figure 16A:
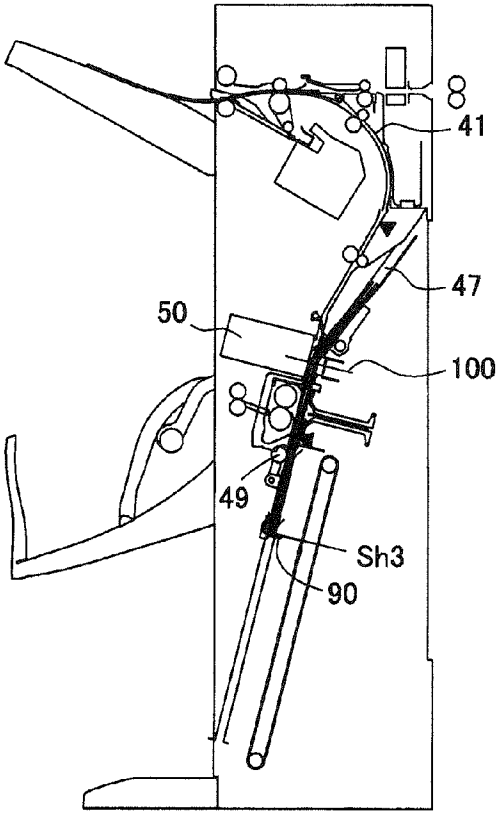

FIG. 16A illustrates a state where the stopper section 90 is moved up from the sheet (bundle) rear end branching point passing position Sh1 to adhesive tape transfer position Sh3. At a start timing of the movement, the rear end of the second (next) paper sheet is biased toward the retreat path 47 by the deflection guide 44 and is therefore switchback-conveyed along the retreat path 47 in a bundle with the first (preceding) paper sheet. As described above, the Sh3 is a position at which the adhesive tape stamper 51 of the adhesive application device 50 presses the transfer tape AT against the half position of the second (next) paper sheet in the sheet conveying direction for application of the adhesive. The adhesive application device 50 is activated to apply the adhesive onto the next paper sheet and, at the same time, the next and preceding paper sheets are pressed against each other for bonding. At this position, in particular, the transfer head 72 presses the position at which the adhesive has been applied, so that the paper sheets are reliably boded to each other. At this time, a leading end of the third paper sheet is entering the carry-in path 41.

FIG. 16B illustrates a state where the stopper section 90 is moved down to the adhesive tape concealing position (next sheet receiving position/position 100 in the drawing) Sh4 so as to carry in the adhesive-applied positions of the respective first and second paper sheets that have been bonded to each other into the retreat path 47, and carry-in of the third paper sheet is waited for. The gripper 91 of the stopper section 90 grips the paper sheets during movement of the paper sheet bundle and application of the adhesive, but releases the gripping of the paper sheets when the next paper sheet is received. FIG. 16B illustrates the same state as that illustrated in FIG. 14B. Afterward, processes from FIG. 14B to FIG. 16B are repeated until the second to last paper sheet constituting the paper sheet bundle is carried in.

In the present embodiment, it is assumed that the third paper sheet is the last paper sheet constituting the paper sheet bundle.

Figure 17B:
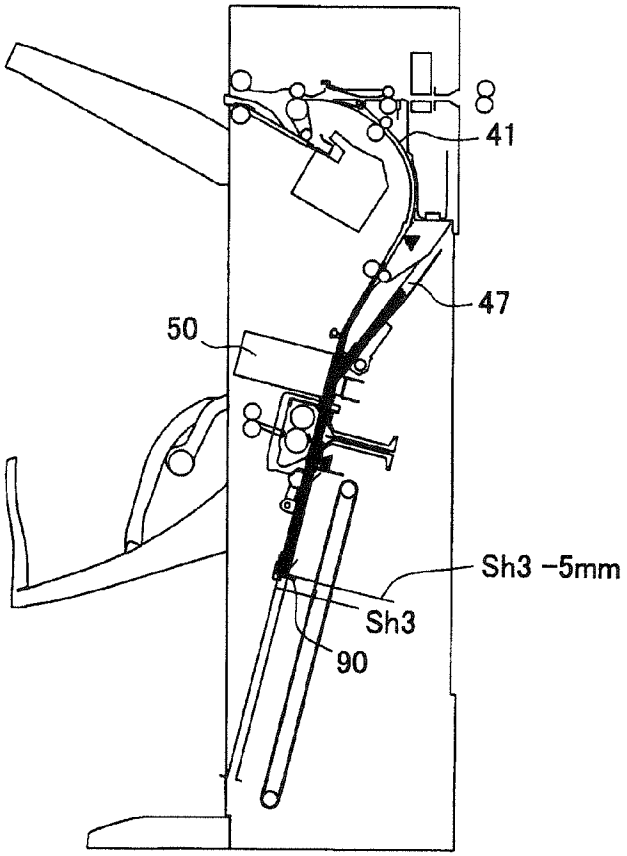
Figure 17A:
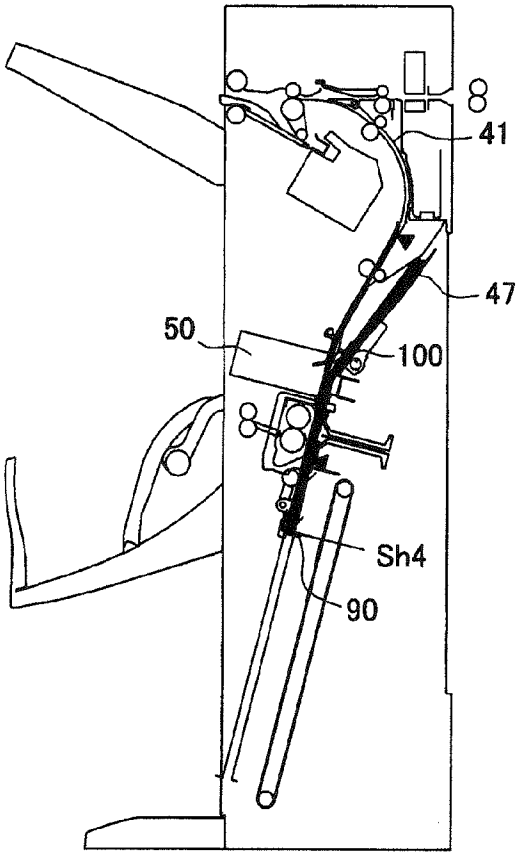

FIG. 17A illustrates a state where the adhesive-applied position of the second paper sheet is situated in the retreat path 47 and where the third paper sheet as the last paper sheet constituting the paper sheet bundle is carried in and abuts its leading end against the stopper section 90. In this state, the sheet side edge aligning member 48 is activated to press the side edges of the third sheet paper and first and second paper sheets a part of each of which is situated in the retreat path 47 for alignment. For this alignment operation, release of the nipping of the conveying roller 46, retreat of the pressure roller 49 from the sheet pressing position, and release of the gripping of the paper sheet by the gripper 91 are performed in the same manner as for the alignment operation between the first and second paper sheets. Thus, the rear ends of the first and second paper sheets are positioned in the retreat path 47, and the rear end of the third paper sheet is positioned in the carry-in path. In this state, the alignment operation is performed with the leading ends of the first to third paper sheets overlapped with each other.

In a state illustrated in FIG. 17B, the nipping of the conveying roller 46, movement of the pressure roller 49 to the sheet pressing position, and the gripping of the paper sheet by the gripper 91 are performed after completion of the above alignment operation, and then the stopper section 90 is moved down to a position (in the present embodiment, this position is set to a position upstream of the adhesive tape transfer position Sh3 by about 5 mm since the paper sheet is pressed by the sheet pressing slider 71 positioned upstream of the transfer head 72: position Z in FIG. 2) near the adhesive tape transfer position Sh3. This is because the adhesive need not be applied to the last paper sheet, so that the paper sheet is pressed not at the bonding position corresponding to the transfer head 72 but at a position at which only the paper sheet is pressed for bonding between the paper sheets.

Figure 18B:
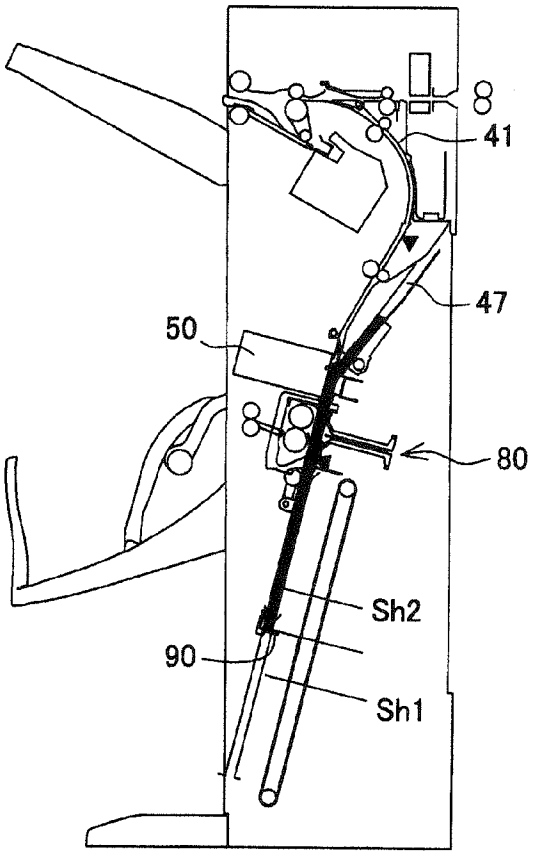
Figure 18A:
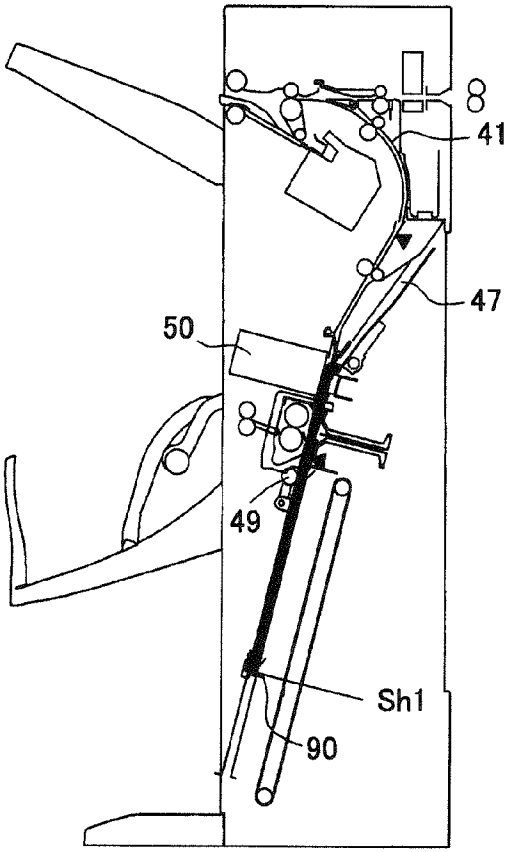

FIG. 18A illustrates a state where after completion of bonding of the last third paper sheet to the preceding first and second paper sheets, the third paper sheet is moved down, while being gripped by the gripper 91 of the stopper section 90, to the sheet (bundle) rear end branching point passing position Sh1 at which the rear end of the third paper sheet exceeds downward the branching point between the carry-in path 41 and retreat path 47. In this state, the first to third paper sheets are press-bonded to each other also by the pressure roller 49 which has been already situated at the sheet pressing position, thereby further securing adhesion between the paper sheets.

FIG. 18B illustrates a state where the stopper section 90 is moved up from the sheet (bundle) rear end branching point passing position Sh1 toward the bonded bundle folding position Sh2 while the paper sheets are being gripped by the gripper 91. With this movement, an upstream end of the paper sheet bundle is carried into the retreat path 47 by the deflection guide 44, and all the three paper sheets are switchback-conveyed.

Figure 19:
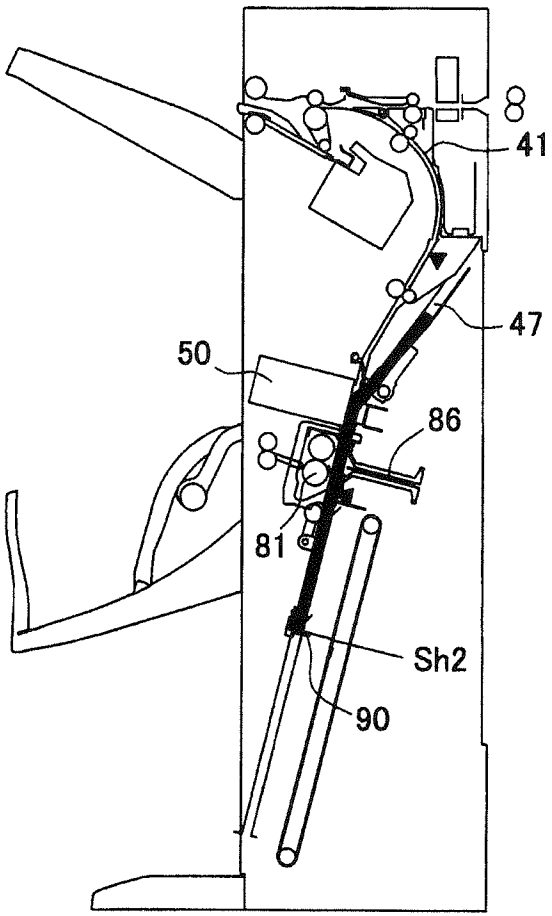
FIG. 19 is a sheet flow diagram continued from FIG. 18B, illustrating a folding processing standby state where the first to third paper sheets are positioned at a folding position.

FIG. 19 illustrates a state where the stopper section 90 is situated at the bonded bundle folding position Sh2. In this state, the movement of the sheet bundle is stopped, the gripping of the paper sheets by the gripper 91 is released, and then folding processing is performed using the folding roller 81 and folding blade 68. This folding blade 86 also presses the adhesive-applied position to further strengthen adhesion between the paper sheets.

As illustrated in FIGS. 17A to 19, for the last paper sheet, the stopper section 90 as the moving member is moved in the order of the adhesive tape concealing position Sh4→position 5 mm upstream of the adhesive tape transfer position Sh3→sheet rear end branching point passing position Sh1→bonded bundle folding position Sh2. That is, before being moved to the folding position Sh2, the paper sheets are subjected to pressing at a plurality of points (sheet pressing slider 71 and pressure roller 49), thereby strengthen adhesion between the paper sheets.

The above conveying order may be changed depending on a type of the adhesive to be used or type of the paper sheets to be bound. For example, as a second conveying order of the last paper sheet, an order of Sh4→Sh1→Sh3 −5 mm→Sh2 may be adopted. According to the second conveying order, the paper sheets are pressed first by the pressure roller 49 and then by the sheet pressing slider 71.

Further, as a third conveying order of the last paper sheet, an order of Sh4→Sh1→Sh2 may be adopted. According to the third conveying order, the paper sheets are pressed by the pressure roller 49, and the subsequent pressing by the sheet pressing slider 71 is omitted.

When an order of Sh4→Sh3 −5 mm→Sh2 is adopted so as to allow the paper sheets to the bonded bundle folding position Sh2 earlier, the paper sheets can be subjected to the folding processing after being pressed by the sheet pressing slider 71. In this case, the folding processing is performed with the rear end of the third paper sheet positioned in the carry-in path 41 and the rear ends of first and second paper sheets positioned in the retreat path 47. In the above respective examples, the "Sh3 −5 mm" is a position of the sheet pressing slider 71 5 mm upstream of the adhesive tape transfer position, at which the adhesive-applied positions of the respective paper sheets other than the last paper sheet are stopped so as to be pressed by the sheet pressing slider 71 for bonding. This "Sh3 −5 mm" position may appropriately be change as long as the last paper sheet applied with no adhesive and preceding paper sheets can be pressed together for bonding at the adhesive-applied position of the preceding paper sheets.

Figure 21A:
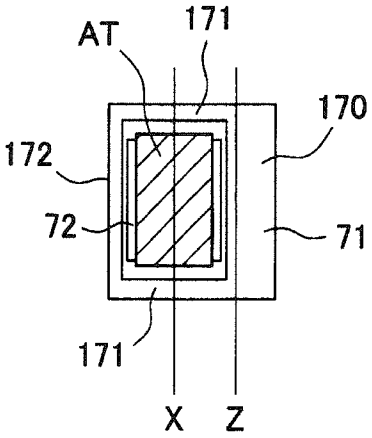
Figure 21B:
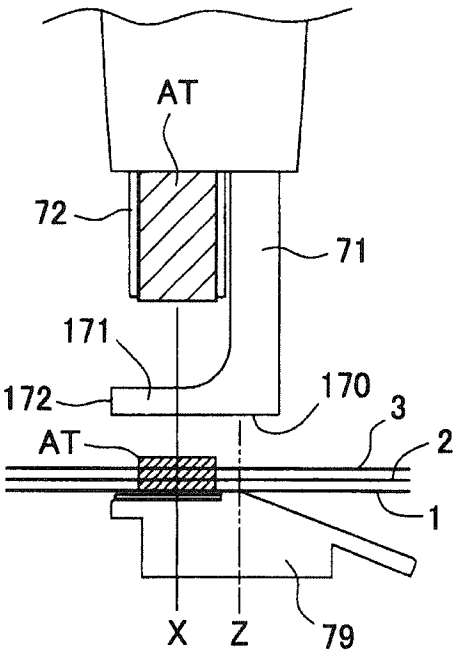
Figure 21C:
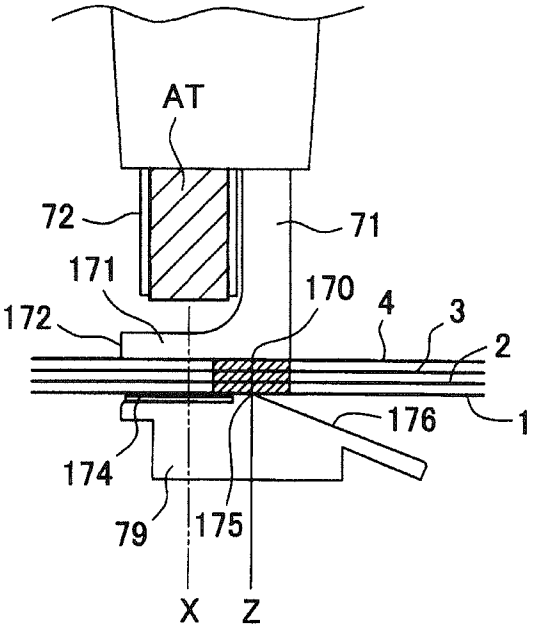

The following describes more in detail the pressing operation of the sheet pressing slider 71 for bonding the last paper sheet and preceding bonded paper sheets using FIGS. 21A to 21C and FIGS. 22A and 22B. FIGS. 21A to 21C are explanatory view illustrating a relationship between the sheet pressing slider 71 illustrated in FIGS. 3, 4, 6A to 6D and platen 79.

Figure 22B:
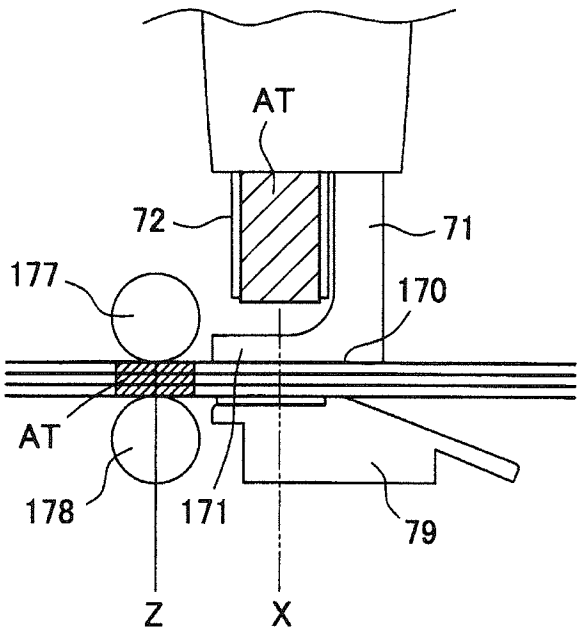
Figure 22A:
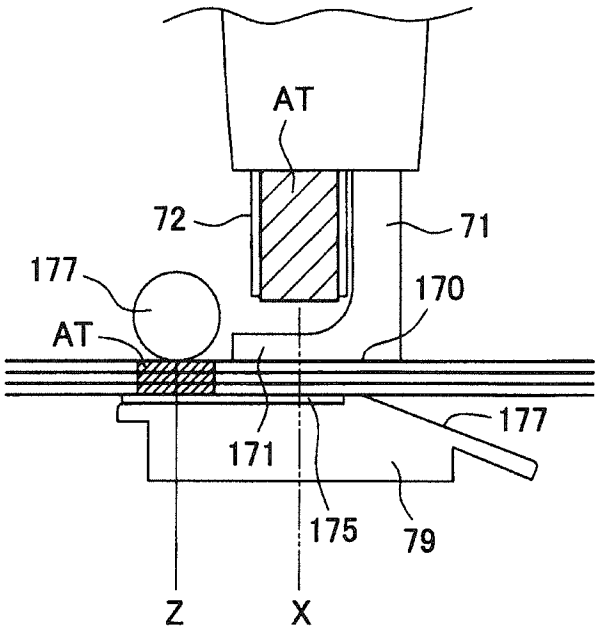

FIGS. 22A and 22B each illustrate a modification of the pressing mechanism of the sheet pressing slider. FIG. 22A illustrates a mechanism that uses a pressure roller as a sheet pressing member, and FIG. 22B illustrates a mechanism that uses a pair of rollers as a sheet pressing member.

FIG. 21A is a bottom view of the sheet pressing slider 71. As illustrated in FIG. 21A, the sheet pressing slider 71 includes a pressing portion 170 having a substantially quadrangular shape and configured to press a comparatively wide area of the paper sheet, side pressing portions 171 extending from both sides of the pressing portion 170, and a leading end pressing portion 172 connecting leading sides of the side pressing portions 171. Inside the above pressing portions, the transfer head 72 supporting the adhesive tape AT is positioned. A symbol X in the drawing denotes a center position of the adhesive tape AT, and the adhesive of the adhesive tape is applied onto the paper sheet with the position X as a center. A symbol Z denotes a sheet pressing position at which the adhesive-applied positions of the paper sheets preceding a last paper sheet to be described later are subjected to pressing.

FIG. 21B illustrates a state where the adhesive of the adhesive tape AT is applied onto the newly conveyed and positioned third paper sheet. That is, first the paper sheets are pressed against the platen by the sheet pressing slider 71. Then, with the movement of the sheet pressing slider 71, a new adhesive surface of the adhesive tape AT is exposed, and the transfer head 72 is pressed against the paper sheet on the platen 79. As a result, the adhesive of the adhesive tape AT is applied onto the new third paper sheet, and preceding first and second paper sheets and third paper sheet are bonded to each other at the adhesive-applied position. After completion of the adhesive application and paper sheet bonding, the transfer head 72 and sheet pressing slider 71 are separated from the paper sheet as illustrated.

The above adhesive application and paper sheet bonding are repeated up to carry-in of the second to last paper sheet. The adhesive application and paper sheet bonding are performed for each carry-in of the paper sheet, and the carried-in paper sheets are bound together.

FIG. 21C illustrates a position of the sheet pressing slider 71 with respect to the last paper sheet (in this example, fourth paper sheet). As described above, the last fourth paper sheet is applied with no adhesive, and fourth paper sheet and the preceding first to third paper sheets are pressed together for bonding. At the bonding position X for the preceding first to third paper sheets, the transfer head 72 is pressed against the paper sheet. To avoid this, the adhesive application position is set at a position 5 mm upstream of the bonding position X in the present embodiment. At this position, the paper sheets are pressed between the pressing portion 170 having a comparatively wide pressing area and platen 79. With this pressing, the last fourth paper sheet is pressed against the adhesive-applied on the preceding third paper sheet and bonded thereto.

The platen 79 includes a platen guide portion 176 for guiding conveyance of the paper sheet from the upstream side, a last sheet pressing portion 175, and a platen cushioning portion 174 positioned facing the transfer head 72 and applied with a slightly elastic sheet for backup of the adhesive application and paper sheet bonding. With this configuration, the paper sheets are reliably bonded to each other.

FIGS. 22A and 22B each illustrate a modification of the pressing mechanism of the sheet pressing slider 71. FIG. 22A illustrates a mechanism that uses a pressure roller 177 as a sheet pressing member. The pressure roller 177 is provided at a position facing a downstream extended portion of the platen 79 and is configured to be movable between a position facing a downstream extended portion of the platen 79 and is moved, by a not illustrated mechanism, between a position pressing the last paper sheet (in this example, all the paper sheets including the fourth paper sheet; the same applies to the following) against the platen and a position separated therefrom. In this modification, a sheet pressing position Z for the last paper sheet is positioned downstream of the bonding position X. FIG. 22B illustrates a mechanism in which a backup roller 178 as a member for pressing the last paper sheet is disposed opposite to the pressure roller 177. That is, bonding of the last paper sheet is performed by the roller pair. By pressing the last paper sheet using both the pressing portion 170 of the sheet pressing slider 71 and pressure roller 177 in the above mechanisms, the paper sheets can be bonded to each other more reliably.

[Mechanism and Operation of Folding Section]

Figure 20A:
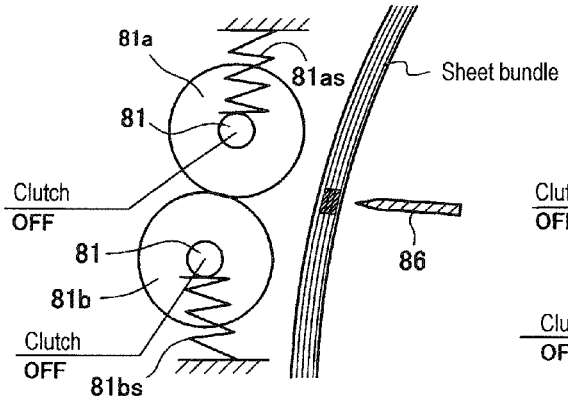

The following describes a configuration of the folding section 80 that applies folding processing to the bonded bundle at the bonded bundle folding position Sh2. As illustrated in FIG. 20A, there are provided, at the folding position Y disposed downstream of the adhesive application device 50, a folding roller 81 for folding the bonded paper sheet bundle and a folding blade 86 for inserting the paper sheet bundle into a nip position of the folding roller 81. The folding roller 81 is constituted by rollers 81*a* and 81*b* brought into pressure contact with each other. The rollers 81*a* and 81*b* are each formed to have a length substantially corresponding to the maximum width of the paper sheet. Rotary shafts of the respective rollers 81*a* and 81*b* constituting the folding roller 81 are fitted respectively into long grooves of a not illustrated device frame and are biased in a pressure-contact direction by respective compression springs 81*a*S and 81*b*S so as to allow the rollers 81*a* and 81*b* to be brought into pressure contact and coupled with each other. The folding roller may have a structure in which at least one of the rollers 81*a* and 81*b* is axially supported so as to be movable to the pressure-contact direction and is provided with the compression spring.

The pair of rollers 81*a* and 81*b* are each formed of a material, such as a rubber, having a large friction coefficient. This is for conveying the paper sheet bundle in a roller rotation direction while folding the same by a soft material such as a rubber, and the rollers 81*a* and 81*b* may be formed by applying lining to a rubber material.

The following describes an operation of folding the paper sheet bundle by means of the above folding roller 81 with reference to FIGS. 20A to 20D. The pair of rollers 81*a* and 81*b* are positioned above the stacker section 40 and below the adhesive application device 50, and the folding blade 86 having a knife edge is provided at a position facing the roller pair 81*a* and 81*b* with the bonded paper sheet bundle supported by the stacker section 40 interposed therebetween. The folding blade 86 is supported by a device frame so as to be reciprocatable between a standby position illustrated in FIG. 20A and a nip position illustrated in FIG. 20C.

The paper sheet bundle supported in a bundle in the stacker section 45 is stopped by the stopper section 90 in a state illustrated in FIG. 20A, and the folding position of the paper sheet bundle, to which the adhesive is applied by the adhesive tape stampers 51, is positioned at the folding position. Upon acquisition of a set completion signal of the paper sheet bundle, a drive controller ("sheet folding operation controller 202"; the same applies to the following) turns off a clutch.

Figure 20B:
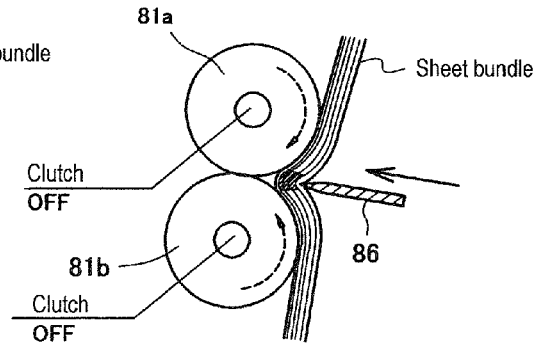
Figure 20C:
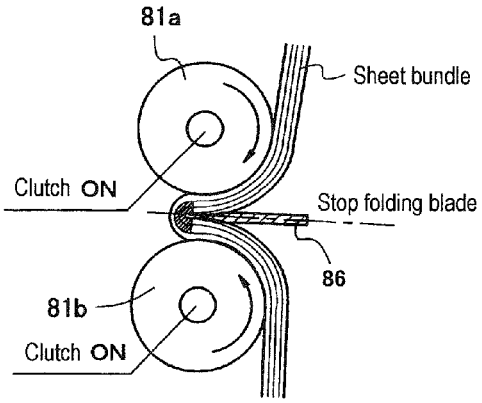
Figure 20D:
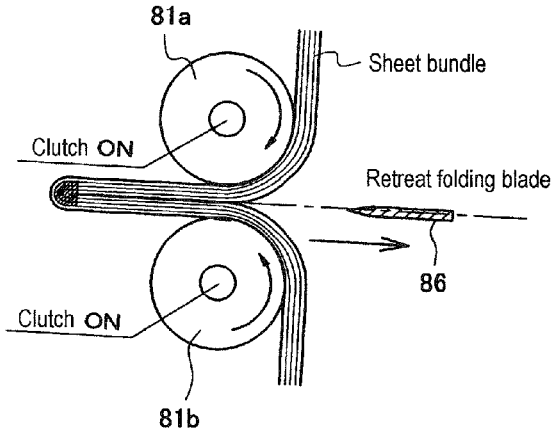

The sheet folding operation controller 202 moves the folding blade 86 from the standby position to nip position at a predetermined speed. Then, as illustrated in FIG. 20B, the paper sheet bundle is bent by the folding blade 86 at the folded position and is inserted between the rollers 81*a* and 81*b*. At this time, the pair of rollers 81*a* and 81*b* are driven into rotation along with the movement of the paper sheet bundle by the folding blade 86. Then, the sheet folding operation controller 202 stops a blade drive motor (not illustrated) after elapse of an estimated time period during which the paper sheet bundle reaches a predetermined nip position to stop the folding blade 86 at a position illustrated in FIG. 20C. Around this time, the sheet folding operation controller 202 turns ON the not illustrated clutch to drive the folding roller 81 into rotation. Then, the paper sheet bundle is fed in a delivery direction (leftward in FIG. 20C). Thereafter, as illustrated in FIG. 20D, the sheet folding operation controller 202 moves the folding blade 86 positioned at the nip position toward the standby position concurrently with the delivery of the paper sheet bundle by the folding roller 81.

When the thus folded paper sheet bundle is pushed between the folding rollers 81*a* and 81*b*, an outermost paper sheet contacting a roller surface is not drawn completely between the rotating rollers. That is, the folding roller 81 is rotated following the movement of the inserted (pushed) paper sheet bundle, preventing only the paper sheet contacting the roller from being caught between the rollers prior to the other paper sheets. Further, since the roller is rotated following the movement of the inserted paper sheet bundle, the roller surface and the outermost paper sheet contacting the roller surface are not rubbed with each other, so that image rubbing-off does not occur.

Referring back to FIG. 2, a sheet transfer path (hereinafter, referred to merely as "transfer path") for guiding the sheet bundle folded in a booklet form to the second sheet discharge tray 22 for storage is provided downstream of the folding roller 81, and the paper sheet bundle folded in two into a booklet by the folding roller 81 is carried out to the second sheet discharge tray 22 by the bundle discharge roller 95 provided at an exit of the transfer path and having the bundle kick-out piece. The discharged paper sheet bundle is stored on the second sheet discharge tray 22 by the bundle press guide 96 and bundle presser 97 for preventing expansion of the folded paper sheet bundle.

[Control Configuration]

Figure 23:
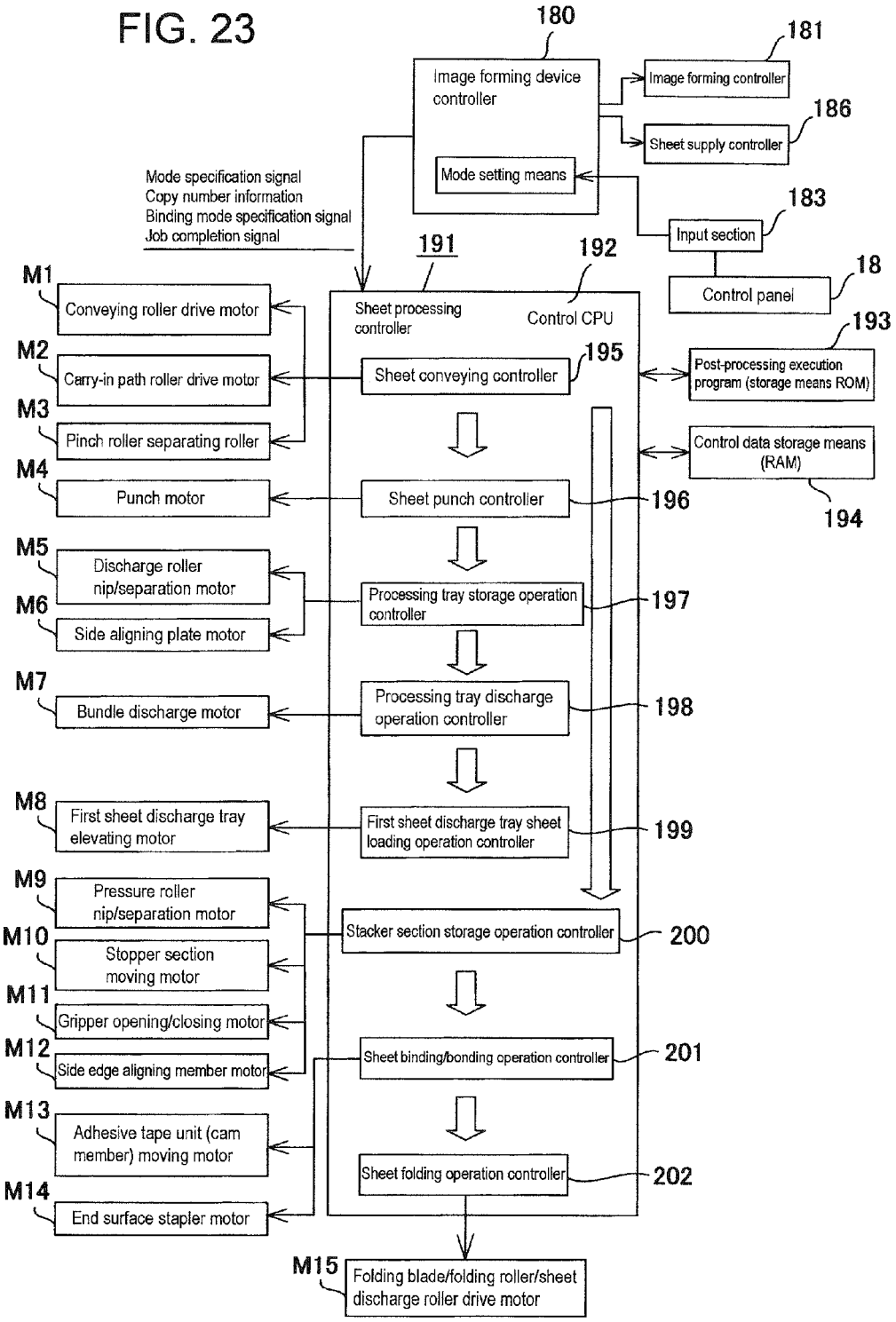
FIG. 23 is an explanatory view of a control configuration in the entire configuration illustrated in FIG. 1.

The following describes a system control configuration for the above-described image forming device with reference to a block diagram of FIG. 23. The system for the image forming device illustrated in FIG. 1 includes an image forming device controller 180 for the image forming device A and a sheet processing controller 191 for the sheet processing device B. The image forming device controller 180 includes an image forming controller 181, a sheet supply controller 186, and an input section 183. A user sets "image forming mode" or "sheet processing mode" through a control panel 18 provided in the input section 183. As described above, in the image forming mode, the image forming conditions such as a print copy count specification, a sheet size specification, a color or black-and-white printing specification, enlarged or reduced printing specification, a single- or double-side printing specification are set. Then, the image forming device controller 180 controls the image forming controller and sheet supply controller according to the set image forming conditions to form an image onto a predetermined paper sheet and carries out the resultant paper sheet through the main body discharge port 3.

At the same time, the user sets the sheet processing mode through the control panel 18. The sheet processing mode includes, e.g., a "print-out mode", a "staple-binding mode", and a "bonded sheet bundle folding mode". The image forming device controller 180 transfers the set sheet processing mode, the number of paper sheets, copy number information, and binding or bonding mode (binding at one or a plurality of positions) information to the sheet processing controller 191.

The sheet processing controller 191 includes a control CPU 192 that operates the sheet processing device B in accordance with the specified finishing mode, a ROM 193 that stores an operation program, and a RAM 194 that stores control data. The control CPU 192 includes a sheet conveying controller 195 that executes conveyance of the paper sheet fed to the carry-in port 23, a sheet punch controller 196 that uses a punch unit 28 to perform punch operation for the paper sheet, a processing tray storage operation controller 197 that uses the processing tray 29 to perform sheet storage operation, a processing tray discharge operation controller 198 that discharges the paper sheet bundle from the processing tray 29, and a first sheet discharge tray sheet loading operation controller 199 that moved vertically the first sheet discharge tray 21 in accordance with a storage amount of the paper sheets or paper sheet bundle discharged from the processing tray.

The sheet processing controller 191 further includes a stacker section storage operation controller 200 for controlling bonding and folding operations while storing the paper sheets in the stacker section 40, a sheet binding/bonding operation controller 201 for instructing a sheet bonding operation, and a sheet folding operation controller 202 for folding the paper sheet bundle bonded with adhesive in two. The sheet binding/bonding operation controller 201 also controls the end surface stapler 35 that binds the paper sheets stored on the processing tray 29 using a staple. Although not illustrated, the above controllers each receive a position signal from a sensor that detects a position of the sheet conveying path or each member.

A connection between the controllers and motors will be described using FIG. 23. The sheet conveying controller 195 is connected to a control circuit of a drive motor M1 so as to control drive of the carry-in roller 24 and the like that receive the paper sheet from the image forming device A and conveys it. The sheet conveying controller 195 once switchback-conveys the paper sheet to the second switchback path SP2 to put the paper sheet on standby therein when carrying in the paper sheet to the processing tray 29 and then discharges the paper sheet together with a next paper sheet. This is done so as to continue a series of processing without stopping the operation on the image forming device A side. The sheet conveying controller 195 controls the drive motor M2 that can forward/backward rotate the path carry-in roller 45 in the carry-in path 41 so as to enable the switchback conveyance. The sheet conveying controller 195 also controls a separating motor 131 (M3) that separates the pinch roller 125 from the drive roller 120 when paper sheet alignment is performed with the leading end of the paper sheet positioned in the stacker section 40 and rear end thereof positioned in the carry-in path 41.

The sheet punch controller 196 is connected to a control circuit of a punch motor M4 so as to punch a punch hole in the paper sheet.

The processing tray storage operation controller 197 is connected to a control circuit of a nip/separation motor M5 that nips and separates the sheet discharge roller 25 so as to carry in the paper sheet to the processing tray 29 or first sheet discharge tray 21 or carry out the paper sheet from the processing tray 29. The processing tray storage operation controller 197 is also connected to a control circuit of a side aligning plate motor M6 that reciprocates the side aligning plate 36 in the sheet width direction so as to align the paper sheets on the processing tray 29.

The processing tray discharge operation controller 198 is connected to a control circuit of a bundle discharge motor M7 that moves the rear end regulating member 33 toward the sheet discharge port 25*a* so as to discharge, to the first sheet discharge tray, the paper sheet bundle whose end portion is bound with the end surface stapler 35 in the processing tray 29. A control circuit of a first tray elevating motor M8 that elevates the first sheet discharge tray 21 in accordance with an amount of paper sheets stored therein is connected to the first sheet discharge tray sheet loading operation controller 199 and controlled thereby.

The controllers for applying the adhesive onto the half position of the paper sheet in the sheet conveying direction to bond the paper sheets to each other and folding the bonded paper sheets at the adhesive-applied position will be described using FIG. 23. The stacker section storage operation controller 200 is connected to a control circuit of a pressure roller nip/separation motor 141 (M9) so as to move, to the sheet pressing position, the pressure roller 49 positioned about the middle of the stacker section 40 and configured to convey downstream the paper sheet carried into the stacker section 40 while pressing the paper sheet, to drive the pressure roller 49 into rotation, and to backward rotate the pressure roller 49 to separate the same from the paper sheet.

The stacker section storage operation controller 200 is further connected to a control circuit of a stopper section 90 moving motor M10 so as to move the stopper section 90 to move the paper sheet entering the stacker section 40 between the initial home position Sh0, the sheet (bundle) rear end branching point passing position Sh1 at which the rear end of the paper sheet is situated at the branching position between the carry-in path 41 and retreat path 47, bonded bundle folding position Sh2 at which the bonded paper sheet bundle is folded in two, adhesive tape transfer position Sh3 at which the preceding paper sheet is switchback-conveyed to the retreat path 47 so as to prevent the adhesive-applied onto the preceding paper sheet from being adhered to the next paper sheet to be carried into the stacker section 40 from the carry-in path 41. The movement of the paper sheet between the above positions is as described above in detail using FIGS. 12A to 19.

The stacker section storage operation controller 200 is further connected to a control circuit of a gripper opening/closing motor 160 (M11) so as to grip the leading end of the paper sheet at the leading end of the stopper section 90 and release its gripping. The timing of the gripping operation of the gripper has already been described, so description thereof is omitted. The stacker section storage operation controller 200 is further connected to a control circuit of an aligning motor 117 (M12) that reciprocates, in the sheet width direction, the sheet side edge aligning member 48 that can align even the paper sheets whose leading ends are positioned at the same position (stacker section 40), while whose rear ends are positioned at different positions (carry-in path 41 and retreat path 47).

The sheet binding/bonding operation controller 201 is connected to a control circuit of a cam moving motor 60 (M13) that reciprocates the cam member 57 between a position that presses the adhesive tape stampers 51 of the adhesive application device 50 against the paper sheet to apply the adhesive and a position separated from the paper sheet. The sheet binding/bonding operation controller 201 is connected to the end surface stapler 35 of the processing tray 29.

As already described, the sheet folding operation controller 202 is configured to rotate or reciprocate the folding blade 86, folding rollers 81*a*, 81*b*, and bundle discharge roller 95 by means of a common motor and is connected to a drive circuit so as to control a drive motor M15.

The controller configured as described above controls the sheet processing device to execute the following operation modes.

"Printout Mode" In this mode, the paper sheets each on which an image has been formed in the image forming device A are sequentially conveyed to the first sheet discharge tray 21 through the sheet carry-in path P1 and sequentially stacked upward in facedown in the order from the first page to n-th page.

"Staple Binding Mode"

In this mode, the image forming device A performs image formation on a series of pages from the first page to n-th page and sequentially carries out in facedown the resultant pages from the main body discharge port 3, as in the printout mode. After being conveyed to the sheet carry-in path P1, each of the paper sheets are switchback-conveyed along the first switchback conveying path SP1 onto the processing tray 29. By repeating this sheet conveying operation, a series of the paper sheets are stored in facedown on the first processing tray 29 in a bundled state. After the paper sheet bundle is stored, the end surface stapler 35 is activated to staple-bind the rear end edge of the paper sheet bundle staked on the tray. After that, the staple-bound paper sheet bundle is carried out to and stored on the first sheet discharge tray 21. As a result, a series of the paper sheets each on which the image has been formed in the image forming device A are staple-bound and stored on the first sheet discharge tray 21.

"Bonded Paper Sheet Bundle Folding Mode"

In this mode, in the sheet processing device B, the paper sheets are applied with the adhesive and then bonded together in a booklet form. To this end, the paper sheet conveyed to the sheet carry-in path P1 is guided to the second switchback conveying path P1 and then to the stacker section 40 by the path carry-in roller 45 and conveying roller 46.

The subsequent flow of the paper sheet, paper sheet bonding operation, and relationship between the preceding and next paper sheet have been already described, so descriptions thereof are omitted. The features of the present embodiment are as follows.

1. Operation in which the preceding paper sheet is retreated to the retreat path 47 after applied with the adhesive so as to prevent the adhesive from being adhered to the next paper sheet is repeated until completion of the paper sheet bundle formation.

2. The adhesive application device 50 applies the adhesive onto the paper sheet and presses this paper sheet against the preceding paper sheet that has already applied with the adhesive to form the paper sheet bundle. This operation is repeated until completion of the paper sheet bundle formation.

3. The paper sheets are aligned by the sheet side edge aligning member 48 before application of the adhesive with the rear ends thereof positioned in the carry-in path 41 and retreat path 47, respectively, and leading ends abutting against the stopper section 90.

4. The above adhesive application by the adhesive application device 50 and paper sheet movement by the stopper section 90 are performed with the leading end of the paper sheet gripped by the gripper 91. On the other hand, when the paper sheets are aligned, or when the next paper sheet to be conveyed to the stopper section 90 is received, the gripping is released.

5. The adhesive application device 50 groups the adhesive tape stampers 51 and presses the adhesive against the paper sheet in units of the group for adhesive application.

6. The adhesive tape stamper 51 is pressed for a certain time so that a constant pressing force is applied by the spring force of the pressure spring 62.

7. The adhesive application device 50 uses the sheet presser 65 to press the paper sheet before application of the adhesive onto the paper sheet so as to prevent displacement or flapping of the paper sheet.

8. A part of the sheet conveying path or retreat path is incorporated in the adhesive application device 50 as a unit, and this adhesive application device 50 is incorporated in the stacker section 40 of the sheet processing device B. With this configuration, displacement between the paper sheet and each member caused due to the movement of the paper sheet can be reduced.

9. For the last paper sheet, the adhesive application is not performed, and the pressing position is shifted to the upstream side so as to secure the adhesion to the preceding paper sheet.

After the adhesive application and bundle generation operations are performed in the stacker section under the above control, the generated paper sheet bundle is subjected to folding and then carried out to the second sheet discharge tray 22.

What is claimed is:

1. A sheet processing device that applies an adhesive onto a paper sheet for bonding paper sheets, comprising:

a carry-in path along which the paper sheet is carried in;

a stacker section that stores the paper sheet conveyed along the carry-in path;

a regulating member that regulates the paper sheet stored in the stacker section;

a moving member that moves the stored paper sheet;

a bonding member that applies the adhesive onto the paper sheet at a bonding position; and a retreat path that branches off from the carry-in path, along which at least a part of the paper sheet stored in the stacker section is retreated in a direction opposite to a sheet carry-in direction, wherein the bonding member is disposed at a merging point between the carry-in path and retreat path, an adhesive-applied position of a preceding paper sheet is retreated to the retreat path by the moving member when a next paper sheet is carried into the stacker section, and then the next paper sheet is moved to the bonding position for adhesive application, and the above paper sheet retreat operation and adhesive application operation are repeated to generate a paper sheet bundle.

2. The sheet processing device according to claim 1, further comprising a folding section that folds the paper sheets bonded by the bonding member, the folding section including a folding roller and a folding blade for moving the paper sheet bundle toward the folding roller, wherein the preceding paper sheet applied with the adhesive and next paper sheet are moved to the bonding position by the moving member, then adhesive is applied to the next paper sheet, and the bonded paper sheets are moved to a folding position and folded with the bonding position pressed by the folding blade.

3. The sheet processing device according to claim 1, further comprising, at a downstream side of a branching position between the carry-in path and retreat path, a deflection guide that biases a rear end of the paper sheet conveyed from the carry-in path, the deflection guide being disposed at a plurality of positions in a direction crossing a sheet width direction so as to avoid an application position of the adhesive-applied by the bonding member.

4. The sheet processing device according to claim 1, wherein the bonding member includes a transfer tape having the adhesive on a tape base material and configured to press the transfer tape against the paper sheet to apply the adhesive onto the paper sheet and bond the paper sheets, and in the adhesive application operation, the preceding paper sheet is retreated to the retreat path, followed by carry-in of the next sheet, and both paper sheets are moved to a position corresponding to the bonding member.

5. The sheet processing device according to claim 1, further comprising an aligning member that aligns the paper sheets stored in the stacker section, wherein in a state where leading end sides of the preceding and next paper sheets are overlapped with each other with the adhesive-applied position of the preceding paper sheet at which the adhesive is applied by the bonding member positioned in the retreat path and a rear end side of the next paper sheet positioned in the carry-in path, the aligning member performs sheet alignment before the bonding member applies the adhesive onto the next paper sheet.

6. The sheet processing device according to claim 5, wherein a folding section including a folding roller that folds the paper sheet bundle bound with the adhesive-applied by the bonding member and a folding blade for moving the paper sheet bundle toward the folding roller is provided downstream of the bonding member, wherein the aligning member is disposed upstream and downstream of the folding section.

7. The sheet processing device according to claim 5, wherein a conveying roller disposed in the conveying path and a pressure roller disposed in the stacker section so as to convey the paper sheet while pressure-contacting the paper sheet are each configured to contact and separate from the paper sheet, and in the aligning operation of the aligning member, both of the pressure and conveying rollers are separated from the paper sheet.

8. The sheet processing device according to claim 1, wherein a gripper for releasably gripping the paper sheet is provided in the regulating member to constitute the moving member for moving the paper sheet, and when the adhesive application is performed in a state where the preceding and next paper sheets are moved to the bonding position at which the adhesive is to be applied onto the paper sheet by the bonding member after the adhesive-applied position of the preceding paper sheet at which the adhesive is applied by the bonding member is moved to the retreat path, the next paper sheet is received, and leading end sides of the preceding and next paper sheets are overlapped with each other, the paper sheets are gripped by the gripper.

9. The sheet processing device according to claim 8, wherein an aligning member that aligns the paper sheets stored in the stacker section, and when the next paper sheet to be conveyed from the carry-in path to the stacker section is received and when the paper sheets are aligned with the next paper sheet and preceding paper sheet a part of which is positioned in the retreat path overlapped with each other, the gripping of the paper sheets by the gripper is released.

10. The sheet processing device according to claim 1, further comprising a pressing member that presses the paper sheet at a position different from the position at which the adhesive of the bonding member is applied, wherein when a paper sheet to be carried into a platen is the last paper sheet to be bonded, the adhesive application operation of the bonding member for the last paper sheet is not performed, but the adhesive-applied position is moved to a pressing position of the pressing member for paper sheet pressing.

11. The sheet processing device according to claim 10, wherein the sheet pressing member presses the paper sheets against the platen.

12. The sheet processing device according to claim 10, wherein a position of the sheet pressing member is set to an upstream side portion on the platen in a sheet conveying direction.

13. The sheet processing device according to claim 10, wherein the sheet pressing member is constituted by a pressure roller, and the pressure roller presses the paper sheets at a position on downstream side of the platen in the sheet conveying direction.

14. The sheet processing device according to claim 10, wherein the sheet pressing member is constituted by a pair of pressure rollers that hold the paper sheets from front and rear surfaces thereof at a position adjacent to the platen.

15. An image forming device comprising:

an image forming section that forms an image onto a paper sheet; and a sheet processing device that applies predetermined processing to the paper sheet from the image forming section, the sheet processing device being provided with a configuration as claimed in claim 1.

16. A sheet bonding method of a sheet processing device that applies an adhesive onto a paper sheet for bonding paper sheets, the sheet processing device including: a carry-in path along which the paper sheet is carried in; a stacker section that stores the paper sheet conveyed along the carry-in path; a retreat path that branches off from the carry-in path, along which at least a part of the paper sheet stored in the stacker section is retreated in a direction opposite to a sheet carry-in direction; and a bonding member that applies the adhesive onto the paper sheet at a merging point between the carry-in path and retreat path, the method comprising the steps of:

applying the adhesive onto a preceding paper sheet at a bonding position;

retreating an adhesive-applied position of the preceding paper sheet to the retreat path;

carrying in a next paper sheet to the stacker section;

moving the next paper sheet to the bonding position with leading end sides of the preceding and next paper sheets overlapped with each other for adhesive application and sheet bonding, wherein the above steps are repeated to generate a paper sheet bundle.

17. The sheet bonding method according to claim 16, wherein the sheet processing device further includes an aligning member that aligns the paper sheets stored in the stacker section, and the sheet bonding method further comprises the steps of:

retreating the adhesive-applied position of the preceding paper sheet to the retreat path;

carrying in the next paper sheet to the stacker section; and aligning, before the bonding member applies the adhesive onto the next paper sheet, the paper sheets using the aligning member with the leading end sides of the preceding and next paper sheets overlapped with each other.

18. The sheet bonding method according to claim 16, further comprising, after the aligning step, a step of moving the bonding member from a position separated from the paper sheet to a position pressing the paper sheet to apply the adhesive onto the next paper sheet and bonding the next paper sheet to the preceding paper sheet that has been already applied with the adhesive in the stacker section.

19. The sheet bonding method according to claim 16, wherein the sheet processing device further includes a moving member that moves the paper sheet, the moving member having a gripper for releasably gripping the paper sheet, and the sheet bonding method further comprises a step of moving the next paper sheet to the bonding position with the leading end sides of the preceding and next paper sheets overlapped with each other to apply the adhesive onto the next paper sheet and bonding the preceding and next paper sheets, the step being executed with the paper sheets gripped by the gripper.

20. The sheet bonding method according to claim 16, wherein the sheet processing device further includes a pressing member that presses the paper sheet at a position different from the position at which the adhesive of the bonding member is applied, and the sheet bonding method further comprises a step of, when a paper sheet carried in to the platen is the last paper sheet to be bonded, moving the adhesive-applied position of the preceding paper sheets to the pressing position of the pressing member and presses the paper sheets including the last paper sheet without applying the adhesive onto the last paper sheet.

* * * * *